US009324279B2

(12) United States Patent
Fujiwara et al.

(10) Patent No.: US 9,324,279 B2
(45) Date of Patent: Apr. 26, 2016

(54) ILLUMINATION DEVICE, DISPLAY DEVICE, DATA GENERATION METHOD, NON-TRANSITORY COMPUTER READABLE RECORDING MEDIUM INCLUDING DATA GENERATION PROGRAM FOR GENERATING LIGHT AMOUNT ADJUSTMENT DATA BASED ON TEMPERATURE

(75) Inventors: Kohji Fujiwara, Osaka (JP); Takayuki Murai, Osaka (JP)

(73) Assignee: SHARP KABUSHIKI KAISHA, Osaka (JP)

( * ) Notice: Subject to any disclaimer, the term of this patent is extended or adjusted under 35 U.S.C. 154(b) by 239 days.

(21) Appl. No.: 13/576,665

(22) PCT Filed: Nov. 11, 2010

(86) PCT No.: PCT/JP2010/070090

§ 371 (c)(1),
(2), (4) Date: Aug. 2, 2012

(87) PCT Pub. No.: WO2011/104949

PCT Pub. Date: Sep. 1, 2011

(65) Prior Publication Data

US 2012/0306942 A1 Dec. 6, 2012

(30) Foreign Application Priority Data

Feb. 24, 2010 (JP) ..... 2010-038717

(51) Int. Cl.
*G09G 3/34* (2006.01)
*H05B 33/08* (2006.01)

(52) U.S. Cl.
CPC ..... *G09G 3/3413* (2013.01); *H05B 33/0818* (2013.01); *H05B 33/0854* (2013.01);

(Continued)

(58) Field of Classification Search
USPC ..... 345/82–107, 204, 211–212, 214, 345/690–691
See application file for complete search history.

(56) References Cited

U.S. PATENT DOCUMENTS 6,380,943 B1 4/2002 Morita et al.
2005/0122305 A1* 6/2005 Murao ..... G02F 1/133382 345/101

(Continued)

FOREIGN PATENT DOCUMENTS

JP 2000-194337 A 7/2000
JP 2001-022318 A 1/2001

(Continued)

OTHER PUBLICATIONS

Official Communication issued in International Patent Application No. PCT/JP2010/070090, mailed on Dec. 7, 2010.

*Primary Examiner* — Ryan A Lubit
(74) *Attorney, Agent, or Firm* — Keating & Bennett, LLP

(57) ABSTRACT

A micon unit (11) performs, along at least one direction within the plane of planar light, brightness correction processing for adjusting brightness distribution of the planar light on light source color video signals (RSd, Gsd and BSd) so as to change them into light source color video signals (RSd', GSd' and BSd'), and the micon unit (11) further calculates the total light emission power of all LEDs (52) based on the light source color video signals (RSd', GSd' and BSd'), and performs, when the total light emission power exceeds an allowable light emission power, light emission power correction processing on the light source color video signals (RSd', GSd' and BSd').

12 Claims, 25 Drawing Sheets

(52) U.S. Cl.
CPC .. *G09G2320/0233* (2013.01); *G09G 2320/041* (2013.01); *G09G 2320/062* (2013.01); *G09G 2320/064* (2013.01); *G09G 2320/0646* (2013.01); *G09G 2330/021* (2013.01)

(56) References Cited

U.S. PATENT DOCUMENTS

| | | | | |
|---|---|---|---|---|
| 2005/0264702 | A1 | 12/2005 | Yoshii | |
| 2006/0221047 | A1* | 10/2006 | Tanizoe | G09G 3/3406 345/102 |
| 2007/0291198 | A1* | 12/2007 | Shen | G09G 3/3413 349/69 |
| 2008/0278432 | A1* | 11/2008 | Ohshima | G09G 3/342 345/102 |
| 2009/0021538 | A1* | 1/2009 | Oota | G09G 3/325 345/690 |
| 2009/0195524 | A1* | 8/2009 | Shen | 345/207 |
| 2010/0079508 | A1* | 4/2010 | Hodge et al. | 345/697 |
| 2011/0157262 | A1 | 6/2011 | Fujiwara et al. | |
| 2011/0273488 | A1 | 11/2011 | Fujiwara et al. | |

FOREIGN PATENT DOCUMENTS

| | | | |
|---|---|---|---|
| JP | 2006-011366 | A | 1/2006 |
| JP | 2007-322901 | A | 12/2007 |
| JP | 2008-242342 | A | 10/2008 |
| JP | 2008-304908 | A | 12/2008 |
| JP | 2009-237510 | A | 10/2009 |
| WO | 2010/041504 | A1 | 4/2010 |
| WO | 2010/092713 | A1 | 8/2010 |

* cited by examiner

FIG.5

| Y \ X | 1 | 2 | 3 | 4 | 5 | 6 | 7 | 8 | 9 | 10 | 11 | 12 |
|---|---|---|---|---|---|---|---|---|---|---|---|---|
| 1 | 4095 | 4095 | 4095 | 4095 | 4095 | 4095 | 4095 | 4095 | 4095 | 4095 | 4095 | 4095 |
| 2 | 4095 | 4095 | 4095 | 4095 | 4095 | 4095 | 4095 | 4095 | 4095 | 4095 | 4095 | 4095 |
| 3 | 4095 | 4095 | 4095 | 4095 | 4095 | 4095 | 4095 | 4095 | 4095 | 4095 | 4095 | 4095 |
| 4 | 4095 | 4095 | 4095 | 4095 | 4095 | 4095 | 4095 | 4095 | 4095 | 4095 | 4095 | 4095 |
| 5 | 4095 | 4095 | 4095 | 4095 | 4095 | 4095 | 4095 | 4095 | 4095 | 4095 | 4095 | 4095 |
| 6 | 4095 | 4095 | 4095 | 4095 | 4095 | 4095 | 4095 | 4095 | 4095 | 4095 | 4095 | 4095 |

| X | 1 | 2 | 3 | 4 | 5 | 6 | 7 | 8 | 9 | 10 | 11 | 12 |
|---|---|---|---|---|---|---|---|---|---|---|---|---|
| 200 | 220 | 235 | 243 | 250 | 255 | 255 | 250 | 243 | 235 | 220 | 200 |

FILTER FT1 (X)

| Y \ X | 1 | 2 | 3 | 4 | 5 | 6 | 7 | 8 | 9 | 10 | 11 | 12 |
|---|---|---|---|---|---|---|---|---|---|---|---|---|
| 1 | 3212 | 3533 | 3774 | 3902 | 4015 | 4095 | 4095 | 4015 | 3902 | 3774 | 3533 | 3212 |
| 2 | 3212 | 3533 | 3774 | 3902 | 4015 | 4095 | 4095 | 4015 | 3902 | 3774 | 3533 | 3212 |
| 3 | 3212 | 3533 | 3774 | 3902 | 4015 | 4095 | 4095 | 4015 | 3902 | 3774 | 3533 | 3212 |
| 4 | 3212 | 3533 | 3774 | 3902 | 4015 | 4095 | 4095 | 4015 | 3902 | 3774 | 3533 | 3212 |
| 5 | 3212 | 3533 | 3774 | 3902 | 4015 | 4095 | 4095 | 4015 | 3902 | 3774 | 3533 | 3212 |
| 6 | 3212 | 3533 | 3774 | 3902 | 4015 | 4095 | 4095 | 4015 | 3902 | 3774 | 3533 | 3212 |

| Y | |
|---|---|
| 1 | 230 |
| 2 | 245 |
| 3 | 255 |
| 4 | 255 |
| 5 | 245 |
| 6 | 230 |

FILTER FT1 (Y)

| Y \ X | 1 | 2 | 3 | 4 | 5 | 6 | 7 | 8 | 9 | 10 | 11 | 12 |
|---|---|---|---|---|---|---|---|---|---|---|---|---|
| 1 | 1198 | 908 | 691 | 575 | 474 | 401 | 401 | 474 | 575 | 691 | 908 | 1198 |
| 2 | 1009 | 701 | 469 | 346 | 238 | 161 | 161 | 238 | 346 | 469 | 701 | 1009 |
| 3 | 883 | 562 | 321 | 193 | 80.3 | 0 | 0 | 80.3 | 193 | 321 | 562 | 883 |
| 4 | 883 | 562 | 321 | 193 | 80.3 | 0 | 0 | 80.3 | 193 | 321 | 562 | 883 |
| 5 | 1009 | 701 | 469 | 346 | 238 | 161 | 161 | 238 | 346 | 469 | 701 | 1009 |
| 6 | 1198 | 908 | 691 | 575 | 474 | 401 | 401 | 474 | 575 | 691 | 908 | 1198 |

| Y \ X | 1 | 2 | 3 | 4 | 5 | 6 | 7 | 8 | 9 | 10 | 11 | 12 |
|---|---|---|---|---|---|---|---|---|---|---|---|---|
| 1 | 2897 | 3187 | 3404 | 3520 | 3621 | 3694 | 3694 | 3621 | 3520 | 3404 | 3187 | 2897 |
| 2 | 3086 | 3394 | 3626 | 3749 | 3857 | 3934 | 3934 | 3857 | 3749 | 3626 | 3394 | 3086 |
| 3 | 3212 | 3533 | 3774 | 3902 | 4015 | 4095 | 4095 | 4015 | 3902 | 3774 | 3533 | 3212 |
| 4 | 3212 | 3533 | 3774 | 3902 | 4015 | 4095 | 4095 | 4015 | 3902 | 3774 | 3533 | 3212 |
| 5 | 3086 | 3394 | 3626 | 3749 | 3857 | 3934 | 3934 | 3857 | 3749 | 3626 | 3394 | 3086 |
| 6 | 2897 | 3187 | 3404 | 3520 | 3621 | 3694 | 3694 | 3621 | 3520 | 3404 | 3187 | 2897 |

FIG.14A

7200%

| | | | | | | | | | | | |
|---|---|---|---|---|---|---|---|---|---|---|---|
| 100 | 100 | 100 | 100 | 100 | 100 | 100 | 100 | 100 | 100 | 100 | 100 |
| 100 | 100 | 100 | 100 | 100 | 100 | 100 | 100 | 100 | 100 | 100 | 100 |
| 100 | 100 | 100 | 100 | 100 | 100 | 100 | 100 | 100 | 100 | 100 | 100 |
| 100 | 100 | 100 | 100 | 100 | 100 | 100 | 100 | 100 | 100 | 100 | 100 |
| 100 | 100 | 100 | 100 | 100 | 100 | 100 | 100 | 100 | 100 | 100 | 100 |
| 100 | 100 | 100 | 100 | 100 | 100 | 100 | 100 | 100 | 100 | 100 | 100 |

Y

X

FIG.14B

3600%

| | | | | | | | | | | | |
|---|---|---|---|---|---|---|---|---|---|---|---|
| 50 | 50 | 50 | 50 | 50 | 50 | 50 | 50 | 50 | 50 | 50 | 50 |
| 50 | 50 | 50 | 50 | 50 | 50 | 50 | 50 | 50 | 50 | 50 | 50 |
| 50 | 50 | 50 | 50 | 50 | 50 | 50 | 50 | 50 | 50 | 50 | 50 |
| 50 | 50 | 50 | 50 | 50 | 50 | 50 | 50 | 50 | 50 | 50 | 50 |
| 50 | 50 | 50 | 50 | 50 | 50 | 50 | 50 | 50 | 50 | 50 | 50 |
| 50 | 50 | 50 | 50 | 50 | 50 | 50 | 50 | 50 | 50 | 50 | 50 |

Y

X

FIG.14C

4800%

| | | | | | | | | | | | |
|---|---|---|---|---|---|---|---|---|---|---|---|
| 0 | 0 | 50 | 50 | 50 | 50 | 50 | 50 | 50 | 50 | 0 | 0 |
| 0 | 100 | 100 | 100 | 100 | 100 | 100 | 100 | 100 | 100 | 100 | 0 |
| 0 | 100 | 100 | 100 | 100 | 100 | 100 | 100 | 100 | 100 | 100 | 0 |
| 0 | 100 | 100 | 100 | 100 | 100 | 100 | 100 | 100 | 100 | 100 | 0 |
| 0 | 100 | 100 | 100 | 100 | 100 | 100 | 100 | 100 | 100 | 100 | 0 |
| 0 | 0 | 50 | 50 | 50 | 50 | 50 | 50 | 50 | 50 | 0 | 0 |

Y

X

FIG.14D

3600%

| | | | | | | | | | | | |
|---|---|---|---|---|---|---|---|---|---|---|---|
| 0 | 0 | 37.5 | 37.5 | 37.5 | 37.5 | 37.5 | 37.5 | 37.5 | 37.5 | 0 | 0 |
| 0 | 75.0 | 75.0 | 75.0 | 75.0 | 75.0 | 75.0 | 75.0 | 75.0 | 75.0 | 75.0 | 0 |
| 0 | 75.0 | 75.0 | 75.0 | 75.0 | 75.0 | 75.0 | 75.0 | 75.0 | 75.0 | 75.0 | 0 |
| 0 | 75.0 | 75.0 | 75.0 | 75.0 | 75.0 | 75.0 | 75.0 | 75.0 | 75.0 | 75.0 | 0 |
| 0 | 75.0 | 75.0 | 75.0 | 75.0 | 75.0 | 75.0 | 75.0 | 75.0 | 75.0 | 75.0 | 0 |
| 0 | 0 | 37.5 | 37.5 | 37.5 | 37.5 | 37.5 | 37.5 | 37.5 | 37.5 | 0 | 0 |

Y

X

ILLUMINATION DEVICE, DISPLAY DEVICE, DATA GENERATION METHOD, NON-TRANSITORY COMPUTER READABLE RECORDING MEDIUM INCLUDING DATA GENERATION PROGRAM FOR GENERATING LIGHT AMOUNT ADJUSTMENT DATA BASED ON TEMPERATURE

TECHNICAL FIELD

The present invention relates to a backlight unit that is an example of an illumination device and a liquid crystal display device incorporating a backlight unit. The present invention also relates to a data generation method of generating light amount adjustment data that controls the light source of a backlight unit, a data generation program for generating the light amount adjustment data and a storage medium that stores such a data generation program.

BACKGROUND ART

In general, a liquid crystal display device (display device) incorporating a non-light emission liquid crystal display panel (display panel) includes a backlight unit (illumination device) that supplies light. These days, light from the backlight unit is appropriately controlled, and thus the image quality of the liquid crystal display panel is enhanced.

For example, in the backlight unit of patent document 1, based on an image signal corresponding to a liquid crystal display panel, a light source control signal corresponding to the light source of the backlight unit is corrected, and backlight that is light from the backlight unit is appropriately controlled by the corrected signal (light amount adjustment signal).

RELATED ART DOCUMENT

Patent Document

Patent document 1: JP-A-2007-322901

DISCLOSURE OF THE INVENTION

Problems to be Solved by the Invention

However, in a liquid crystal display device including the backlight unit and the liquid crystal display panel described above, the brightness of the backlight from the backlight unit is adjusted only according to the lightness of the entire display screen. Hence, in the liquid crystal display device described above, it is difficult to adjust the amount of backlight such that, for example, based on the visual characteristic of humans, an area around the center of the liquid crystal display panel is brighter than the other areas.

The present invention is made in view of the foregoing conditions. An object of the present invention is to provide an illumination device and the like that can adjust the amount of light such that a specific region (for example, a region around the center) of a non-light emission display panel is brighter than the other regions.

Means for Solving the Problem

An illumination device includes: a plurality of light sources which are arranged in a plane and which emit light according to light amount adjustment data to form planar light; and a control unit which performs correction processing on light source control data based on image data to generate the light amount adjustment data. In the illumination device, the control unit performs, along at least one direction within a plane of the planar light, brightness correction processing for adjusting brightness distribution of the planar light on the light source control data so as to generate intermediate light source control data. Furthermore, the control unit further calculates a total light emission power of all the light sources based on the intermediate light source control data, and performs, when the total light emission power exceeds an allowable light emission power, light emission power correction processing for adjusting the total light emission power within the allowable light emission power on the intermediate light source control data so as to generate the light amount adjustment data.

In this way, the control unit performs the brightness correction processing along at least one direction, for example, two directions, within the plane of the planar light and the planar light is two-dimensionally subjected to the brightness correction processing. The shape of the brightness distribution of the planar light described above varies; for example, the planar light having the shape of the brightness distribution corresponding to the visual characteristic of human is generated. Moreover, the control unit performs the light emission power correction processing to reduce the light emission power of the light sources necessary for generating the planar light having the shape of the brightness distribution described above. Thus, the planar light supplied from the illumination device can generate the planar light for preventing a person from feeling lack of brightness without light emission power being relatively consumed.

In an example of the brightness correction processing, in each of the directions, a brightness around both ends in the direction is set lower than a brightness around the center.

In the backlight unit described above, the brightness around the center of the planar light is not significantly changed before and after the brightness correction processing; the brightness in the perimeter of the planar light other than the vicinity of the center after the brightness correction processing is lower than that before the brightness correction processing. A person is unlikely to feel that the planar light of the brightness distribution described above relatively lacks brightness (is unlikely to feel that the planar light includes variations in brightness). Furthermore, as the brightness in the perimeter of the planar light is reduced, the light emission power is lowered. In other words, the backlight unit described above can provide the planar light of high quality and also lower the light emission power.

The control unit preferably changes the brightness correction processing according to a specific parameter. For example, the specific parameter may be a display mode of the image data. The specific parameter may be a brightness level of the image data.

When the illumination device includes a temperature measurement portion which measures a temperature of the light sources, the specific parameter may be the result of the measurement by the temperature measurement portion. Preferably, when the specific parameter may be the brightness level of the image data and the result of the measurement by the temperature measurement portion, the level of the brightness correction processing is set stepwise, and the control unit performs the brightness correction processing in the set stepwise order.

In this way, for example, even if a certain type of brightness correction processing where the level difference is increased is changed to another type of brightness correction processing, an intermediate level of brightness correction processing is present between the highest level of brightness correction processing and the lowest level of brightness correction processing. Hence, variations in the brightness of the planar light caused by the changing of the brightness correction processing become unnoticeable.

When the illumination device includes a person detection portion which can detect a person, the specific parameter may be the result of the detection of a position of the person by the person detection portion.

Preferably, when the light emission power correction processing is performed after the brightness correction processing, in a specific example of the light emission power correction processing, the control unit calculates, for the total light emission power, the rate of limitation that is a scaling factor of the allowable light emission power, and multiplies the intermediate light source control data on each of the light sources by the rate of limitation to generate the light amount adjustment data.

The light emission power correction processing is preferably the final type of processing among types of processing performed by the control unit on the light source control data.

In this way, even when the illumination device performs various types of processing other than the light emission power correction processing, as compared with the case where the light emission power correction is performed before the various types of processing, it is possible to reduce the effects of various types of processing on the light emission power correction processing.

The control unit preferably determines, based on the maximum value of the image data, the light source control data on each of the light sources.

In this way, light source control data is increased according to the maximum value of the image data. Under the condition in which the total light emission power of all the light sources is more likely to exceed the allowable light emission power, the light emission power correction processing is performed. Hence, the light emission power of the illumination device can be reliably reduced.

Preferably, when each of the light sources includes light emitting chips of a plurality of colors, and generates white light by mixture of light, and, in the light emission power correction processing, the control unit calculates the total light emission power, the control unit calculates a light emission power for individual light emission colors, calculates the total light emission power from the total sum of the light emission power and multiplies the light emission power for the individual light emission colors by the same rate of limitation to generate the light amount adjustment data.

In this way, while variations in the color tone of the light source including the light emitting chips of different light emission colors are being reduced, the light emission power of the light source is reduced.

When, in the illumination device, each of the light sources includes light emitting chips of a plurality of colors, and generates white light by mixture of light, the control unit may perform a different type of the brightness correction processing for each of the colors. However in the illumination device, when the light sources are light sources of a single color, the control unit preferably performs the brightness correction processing corresponding to the signal color.

A display device including the illumination device described above and a display panel which displays an image corresponding to the image data can also be said to be according to the present invention.

In a data generation method of generating, in an illumination device, light amount adjustment data for controlling light emission of a plurality of light sources that are arranged in a plane to form planar light, the following method can also be said to be according to the present invention.

Specifically, when correction processing is performed on light source control data based on image data to generate the light amount adjustment data, along at least one direction within a plane of the planar light, brightness correction processing for adjusting brightness distribution of the planar light is performed on the light source control data so as to generate intermediate light source control data, and, based on the intermediate light source control data, a total light emission power of all the light sources is further calculated, and, when the total light emission power exceeds an allowable light emission power, light emission power correction processing for adjusting the total light emission power within the allowable light emission power is performed on the intermediate light source control data so as to generate the light amount adjustment data.

In a data generation program for generating, in an illumination device including a plurality of light sources which are arranged in a plane and which emit light according to light amount adjustment data to form planar light and a control unit which performs correction processing on light source control data based on image data to generate the light amount adjustment data, the light amount adjustment data, the following program can also be said to be according to the present invention.

Specifically, the control unit is made, by a data generation program, to perform, along at least one direction within a plane of the planar light, brightness correction processing for adjusting brightness distribution of the planar light on the light source control data so as to generate intermediate light source control data, and to further calculate a total light emission power of all the light sources based on the intermediate light source control data, and perform, when the total light emission power exceeds an allowable light emission power, light emission power correction processing for adjusting the total light emission power within the allowable light emission power on the intermediate light source control data so as to generate the light amount adjustment data.

A computer readable recording medium recording the data generation program described above can also be said to be according to the present invention.

Advantages of the Invention

According to the present invention, the illumination device can generate the planar light for preventing a person from feeling lack of brightness without light emission power being relatively consumed.

BRIEF DESCRIPTION OF DRAWINGS

FIG. 5 An illustration diagram showing a process in which brightness correction processing is temporarily performed, with the filter FT1 (X) in the X direction, on the LEDs that emit light with a PWM value of 4095, and in which furthermore, the brightness correction processing is performed, with the filter FT1 (Y) in the Y direction;

FIG. 14A An illustration diagram, in which, when all the LEDs where 12 LEDs are arranged in the X direction and 6 LEDs are arranged in the Y direction emit light according to the PWM value (for example, 100%), the PWM value is made to correspond to the illumination regions of the individual LEDs;

FIG. 14B An illustration diagram in which the PWM value shown in FIG. 14A is changed by light emission power correction processing;

FIG. 14C An illustration diagram showing an example of the PWM value of the entire illumination region on which the light emission power correction processing is performed;

FIG. 14D An illustration diagram showing the PWM value after the light emission power adjustment;

DESCRIPTION OF EMBODIMENTS

First Embodiment

An embodiment will be described below with reference to accompanying drawings. For convenience, member symbols and the like may be omitted; in that case, other drawings should be referenced. For convenience, a drawing other than a cross-sectional view may be hatched. Examples of values that will be described are simply examples: the present invention is not limited to such values.

Figure 24:
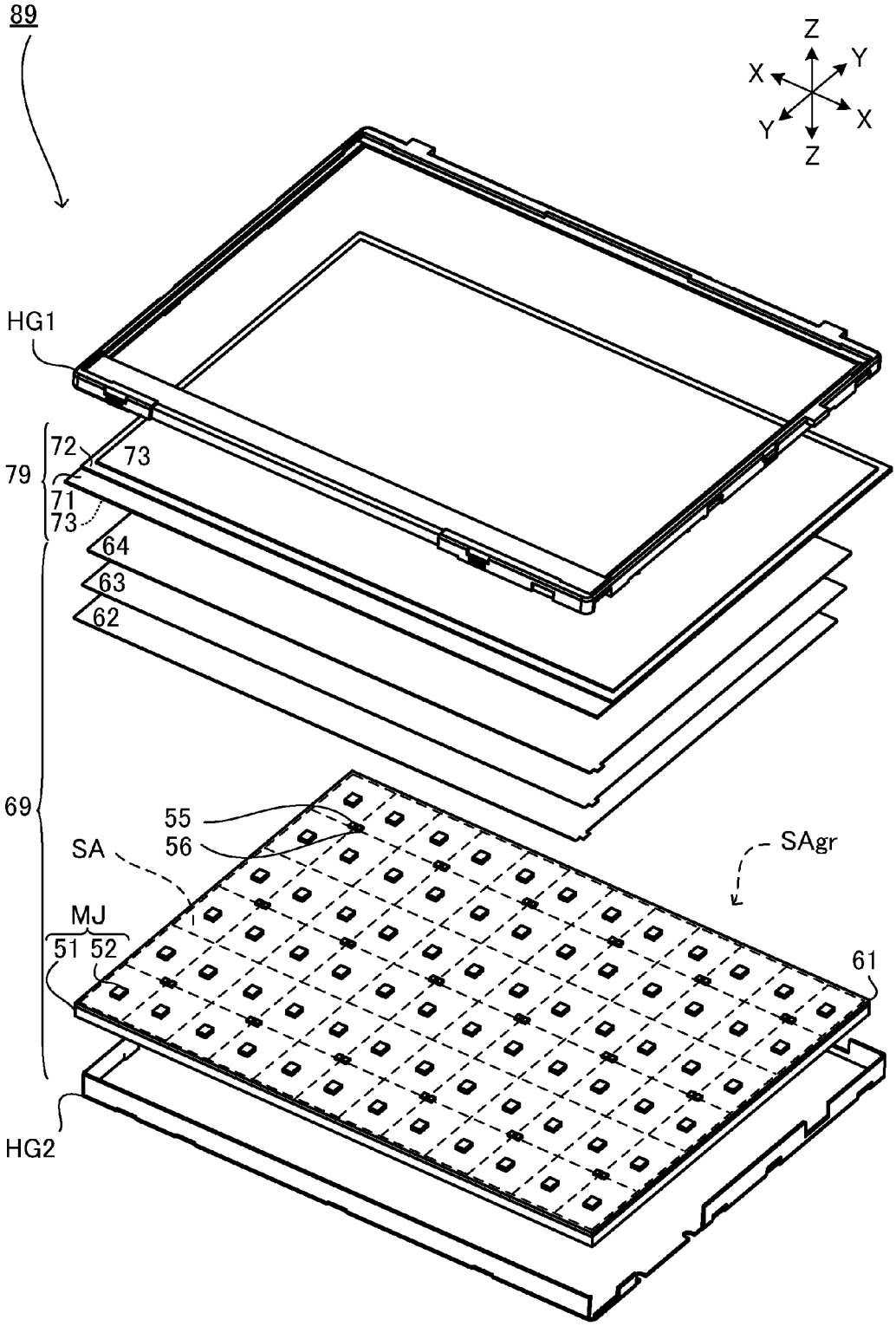
FIG. 24 An exploded perspective view of the liquid crystal display device.

FIG. 24 is an exploded perspective view showing a liquid crystal display device 89 that is an example of a display device. As shown in FIG. 24, the liquid crystal display device 89 includes a liquid crystal display panel (display panel) 79, a backlight unit (illumination device) 69 and a housing HG (HG1 and HG2) that sandwiches these components.

The liquid crystal display panel 79 employs an active matrix method. Hence, in the liquid crystal display panel 79, an active matrix substrate 71 to which active elements such as unillustrated TFTs (thin film transistors) are attached and an opposite substrate 72 opposite the active matrix substrate 71 sandwich liquid crystal (not shown). In other words, the active matrix substrate 71 and the opposite substrate 72 are substrates for sandwiching the liquid crystal and are formed of transparent glass or the like.

An unillustrated sealant is attached to the perimeters of the active matrix substrate 71 and the opposite substrate 72; sealing for the liquid crystal is performed with the sealant described above. Polarization films 73 are attached to sandwich the active matrix substrate 71 and the opposite substrate 72.

Since this liquid crystal display panel 79 is a non-light emission display panel, the liquid crystal display panel 79 receives planar light from the backlight unit 69 and thereby achieves display function. Hence, when the light from the backlight unit 69 can be evenly applied to the entire surface of the liquid crystal display panel 79, the display quality of the liquid crystal display panel 79 is enhanced.

The backlight unit 69 described above includes LED modules MJ, thermistors 55 (temperature measurement portions), photosensors 56, a detection sensor 57 (see FIG. 1), a reflective sheet 61, a diffusion sheet 62 and prism sheets 63 and 64.

The LED module MJ includes a mounting substrate 51 and an LED (light emitting diode) 52. In the mounting substrate 51, unillustrated electrodes are arranged in a plane (for example, in a matrix), and the LED (light source, light emitting element) 52 is mounted on the electrodes. The mounting substrate 51 supplies a current flowing from an unillustrated power supply to the LED 52 through the electrodes.

The LED (light emitting element) 52 is a point light source that receives current to emit light, and is arranged according to the electrodes on the mounting surface of the mounting substrate 51 (the direction of the light emission surface of the LED 52 is the same as the direction of the mounting surface over which the electrodes are placed). Consequently, the LEDs 52 are arranged in a plane on the mounting surfaces of the mounting substrates 51, and generate planar light. As an example of the arrangement of the LEDs 52, there is a planar arrangement that is rectangular and is in a matrix; for convenience, the longitudinal direction of the rectangle is referred to as an X direction and the lateral direction thereof is referred to as a Y direction.

Figure 25A:
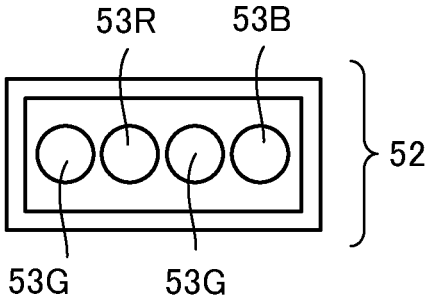
FIG. 25A A front view showing the LED incorporating a plurality of LED chips.

The type of LED 52 is not particularly limited. As an example, as shown in the front view of the LED 52 of FIG. 25A, there is an LED 52 in which one red light emitting (R) LED chip 53R and two green light emitting (G) LED chips 53G and one blue light emitting (B) LED chip 53B are aligned, and in which white light is generated by the mixture of the light.

Figure 25B:
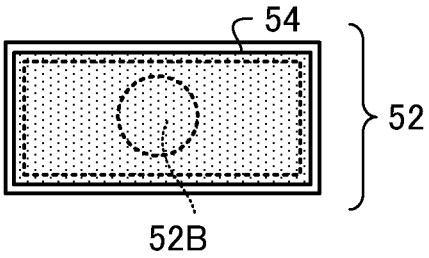
FIG. 25B A front view showing the LED incorporating one LED chip.

As another example, as shown in the front view of the LED 52 of FIG. 25B, there is an LED 52 in which the blue light emitting LED chip 53B and a fluorescent member 54 that receives blue light to emit yellow light are combined (in the following description, unless otherwise specified, the LED 52 in which white light is generated by the mixture of the light is assumed to be used).

The LED modules MJ described above can control the light emission of each of the LEDs 52. Thus, it is possible to partially apply light to the display region of the liquid crystal display panel 79. Hence, in FIG. 24, an illumination region SA that can be controlled by each of the LEDs 52 is represented by broken lines. In other words, one block (one of a plurality of blocks arranged in a matrix) that is a dotted region is the illumination region SA that can be controlled by one LED 52.

The thermistor 55 is a temperature sensor for measuring the temperature of the LEDs 52; one thermistor 55 is mounted on the mounting substrate 51 for four LEDs 52 (specifically, on the mounting substrate 51, the thermistor 55 is mounted around the center of a region surrounded by four LEDs 52).

The photosensor 56 is a light measurement sensor for measuring the brightness of the LEDs 52; as with the thermistor 55, one photosensor 56 is mounted on the mounting substrate 51 for four LEDs 52.

Although the detection sensor (person detection portion) 57 is not shown in FIG. 24 (see FIG. 1), the detection sensor 57 is, for example, an infrared sensor, a camera sensor or an ultrasonic sensor that is known. The detection sensor 57 detects the position of a user (person) in front of the liquid crystal display panel 79 of the liquid crystal display device 89 incorporating the backlight unit 69.

The reflective sheet 61 is a reflective member which is adhered to the mounting surfaces of the mounting substrate 51 so as to avoid the LEDs 52, the thermistors 55 and the photosensors 56; the reflective sheet 61 has a reflective surface on the same side as the light emission side of the LEDs 52. Thus, even when part of the light from the LEDs 52 travels toward the mounting surface of the mounting substrate 51, the light is reflected off the reflective surface of the reflective sheet 61.

The diffusion sheet 62 is so arranged as to cover the LEDs 52 placed in a matrix, diffuses planar light formed with light from a plurality of LEDs 52 and thereby spreads the light over the liquid crystal display panel 79 (the diffusion sheet 62 and the prism sheets 63 and 64 are also collectively referred to as an optical sheet group (62 to 64)).

The prism sheets 63 and 64 are optical sheets that have prism shapes within, for example, a sheet surface and that change the radiation characteristics of light; the prism sheets 63 and 64 are positioned to cover the diffusion sheet 62. Hence, the prism sheets 63 and 64 collect light travelling from the diffusion sheet 62 and enhance the brightness. The directions of diversion of the light collected by the prism sheet 63 and the prism sheet 64 intersect each other.

In the backlight unit 69 described above, the planar light from the LEDs 52 passes through the optical sheet group (62 to 64), and is thereby emitted as backlight whose brightness has been increased. Then, the backlight (planar light) reaches the liquid crystal display panel 79, and an image is displayed on the liquid crystal display panel 79 by the backlight.

The housing HG will now be described. The front housing HG1 and the rear housing HG2 of the housing HG sandwich and fix the backlight unit 69 and the liquid crystal display panel 79 covering the backlight unit 69 (the method of fixing them is not particularly limited). In other words, the front housing HG1 sandwiches the backlight unit 69 and the liquid crystal display panel 79 together with the rear housing HG2, and thus the liquid crystal display device 89 is completed.

The rear housing HG2 stacks and houses, in this order, the LED modules MJ, the reflective sheet 61, the diffusion sheet 62 and the prism sheets 63 and 64; the direction in which they are stacked is referred to as a Z direction (the X direction, the Y direction and the Z direction are preferably perpendicular to each other).

In the backlight unit 69 having a plurality of LEDs 52 arranged in a matrix as described above, since the emission light can be controlled for each of the LEDs 52, it is possible to partially apply light to the display region of the liquid crystal display panel 79. Hence, the backlight unit 69 described above can also be said to be the backlight unit 69 of an active area method (technology for partially applying light to the display region of the liquid crystal display panel 79 is referred to as local dimming).

Figure 1:
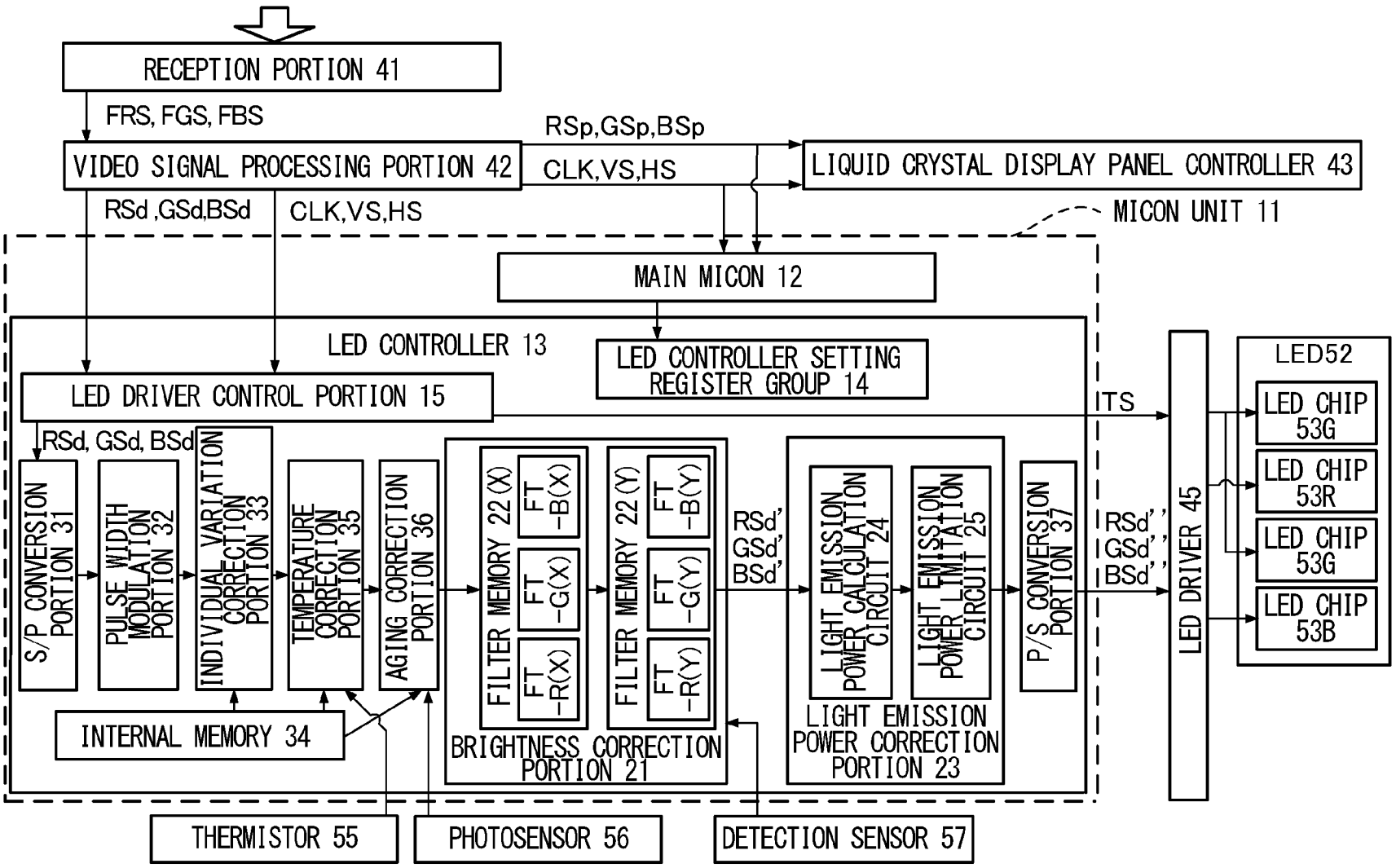
FIG. 1 A block diagram showing various members included in a liquid crystal display device.

Hence, the controlling of light emission by the backlight unit 69 of the active area method discussed above will be described. FIG. 1 is a block diagram showing various members included in the liquid crystal display device 89 (the LED 52 shown in FIG. 1 is one of a plurality of LEDs 52).

As shown in FIG. 1, the liquid crystal display device 89 includes a reception portion 41, a video signal processing portion 42, a liquid crystal display panel controller 43, a main microcomputer (main micon) 12, an LED controller 13, the thermistor 55, the photosensor 56, an LED driver 45 and the LED 52.

The reception portion 41 receives, for example, a video sound signal such as a television broadcast signal (see a white arrow) (a video signal included in the video sound signal will be mainly described below). Then, the reception portion 41 transmits the received video signal to the video signal processing portion 42

For convenience, the video signals transmitted to the video signal processing portion 42 are referred to as basic video signals (image data); among color video signals included in the basic video signals, a signal indicating red is referred to as a basic red video signal FRS, a signal indicating green is referred to as a basic green video signal FGS and a signal indicating blue is referred to as a basic blue video signal FBS.

The video signal processing portion 42 generates process video signals based on the received basic video signals (image data). Then, the video signal processing portion 42 transmits the process video signals both to the liquid crystal display panel controller 43 and the LED controller 13.

The process video signals are, for example, process color video signals (a process red video signal RS, a process green video signal GS and a process blue video signal BS) obtained by processing the basic color video signals (such as the basic red video signal FRS, the basic green video signal FGS and the basic blue video signal FBS) and synchronization signals (such as a clock signal CLK, a vertical synchronization signal VS and a horizontal synchronization signal HS) on the process color video signals.

However, the process color video signal transmitted to the liquid crystal display panel controller 43 is different from the process color video signal transmitted to the LED controller 13. Hence, in order for these process color video signals to be distinguished, the process color video signals transmitted to the liquid crystal display panel controller 43 are referred to as a panel process red video signal RSp, a panel process green video signal GSp and a panel process blue video signal BSp.

On the other hand, the process color video signals transmitted to the LED controller 13 are referred to as a light source red video signal RSd, a light source green video signal GSd and a light source blue video signal BSd (specifically, the light source color video signals (RSd, GSd and BSd) are corrected, and are then transmitted to the LED driver 45, which will be described in detail later).

The liquid crystal display panel controller 43 controls the pixel of the liquid crystal display panel 79 based on the panel process red video signal RSp, the panel process green video signal GSp and the panel process blue video signal BSp and the synchronization signals on these signals.

The main microcomputer (main micon) 12 supervises various types of control on the backlight unit 69, the liquid crystal display panel 79 and the like. The main micon 12 and the LED controller 13 controlled by it may be collectively referred to as a micon unit 11.

The LED controller 13 transmits various control signals to the LED driver 45 under the management (control) of the main micon 12. This LED controller 13 includes an LED controller setting register group 14, an LED driver control portion 15, a serial parallel conversion portion (S/P conversion portion) 31, a pulse width modulation portion 32, an individual variation correction portion 33, an internal memory 34, a temperature correction portion 35, an aging correction portion 36, a brightness correction portion 21, a light emission power correction portion 23 and a parallel serial conversion portion (P/S conversion portion) 37.

The LED controller setting register group 14 temporarily holds various control signals from the main micon 12. In other words, the main micon 12 temporarily controls various members within the LED controller 13 through the LED controller setting register group 14.

An LED driver control portion 22 transmits the light source color video signals (RSd, GSd and BSd) from the video signal processing portion 42 to the S/P conversion portion 31. The LED driver control portion 22 also generates a lighting timing signal TS for the LED 52 (specifically, the LED chips 53) from the synchronization signals (such as the clock signal CLK, the vertical synchronization signal VS and the horizontal synchronization signal HS), and transmits it to the LED driver 45.

The S/P conversion portion 31 converts the light source color video signal transmitted as serial data from the LED driver control portion 22 into parallel data.

The pulse width modulation portion 32 adjusts, with a pulse width modulation (PWM) method, the light emission time of the LED 52 based on the light source color video signal. A signal value used for the pulse width modulation is referred to as a PWM signal (PWM value). The pulse width modulation method is known; for example, it is a method in which one second is divided into 128 sections, and a time width during which lighting is performed for each section is changed (for example, the light emission time is changed by a PWM value of 12 bits=0 to 4095).

The individual variation correction portion 33 previously checks the performance of each of the LED 52, and performs a correction such that individual errors are removed. For example, the individual variation correction portion 33 previously measures the brightness of the LEDs 52 with a specific PWM value. Specifically, the specific PWM value corresponding to each of the LEDs chips 53 is corrected such that the red light emitting LED chip 53R, the green light emitting LED chip 53G and the blue light emitting LED chip 53B are lit and that thus white light having a desired color shade can be generated.

Then, the PWM value corresponding to each of the LEDs 52 (each of the LED chips 53R, 53G and 53B) is further corrected such that a plurality of LEDs 52 are lit and that variations in the brightness of the planar light are removed. Thus, the individual difference (the individual difference in the brightness, and hence variations in the brightness of the planar light) between a plurality of LEDs 52 is corrected.

As the method of performing the correction processing as described above, various types of methods are available; correction processing using a general look-up table (LUT) is employed. In other words, the individual variation correction portion 33 uses a LUT for individual variations in the LEDs 52 stored in the internal memory 34, and thereby performs the correction processing.

The internal memory 34 stores, for example, the LUT for individual variations in the LEDs 52 as described above. The internal memory 34 also stores LUTs that are necessary in the stages of the temperature correction portion 35 and the aging correction portion 36 which succeeds the individual variation correction portion 33.

The temperature correction portion 35 performs a correction with consideration given to the decrease in the brightness of the LED 52 caused by the increase in the temperature resulting from the light emission of the LED 52. For example, the temperature correction portion 35 acquires, with the thermistor 55, temperature data on the LED 52 (in short, the LED chips 53R, 53G and 53B) once every second, acquires a LUT corresponding to the temperature data from the internal memory 34 and performs correction processing (that is, changes the PWM value corresponding to the LED chips 53R, 53G and 53B) for reducing variations in the brightness of the planar light.

The aging correction portion 36 performs a correction with consideration given to the decrease in the brightness of the LED 52 caused by the aging of the LED 52. For example, the aging correction portion 36 acquires, with the photosensor 56, brightness data on the LED 52 (in short, the LED chips 53R, 53G and 53B) once every year, acquires a LUT corresponding to the brightness data from the internal memory 34 and performs correction processing (that is, changes the PWM value corresponding to the LED chips 53R, 53G and 53B) for reducing variations in the brightness of the planar light.

Figure 2:
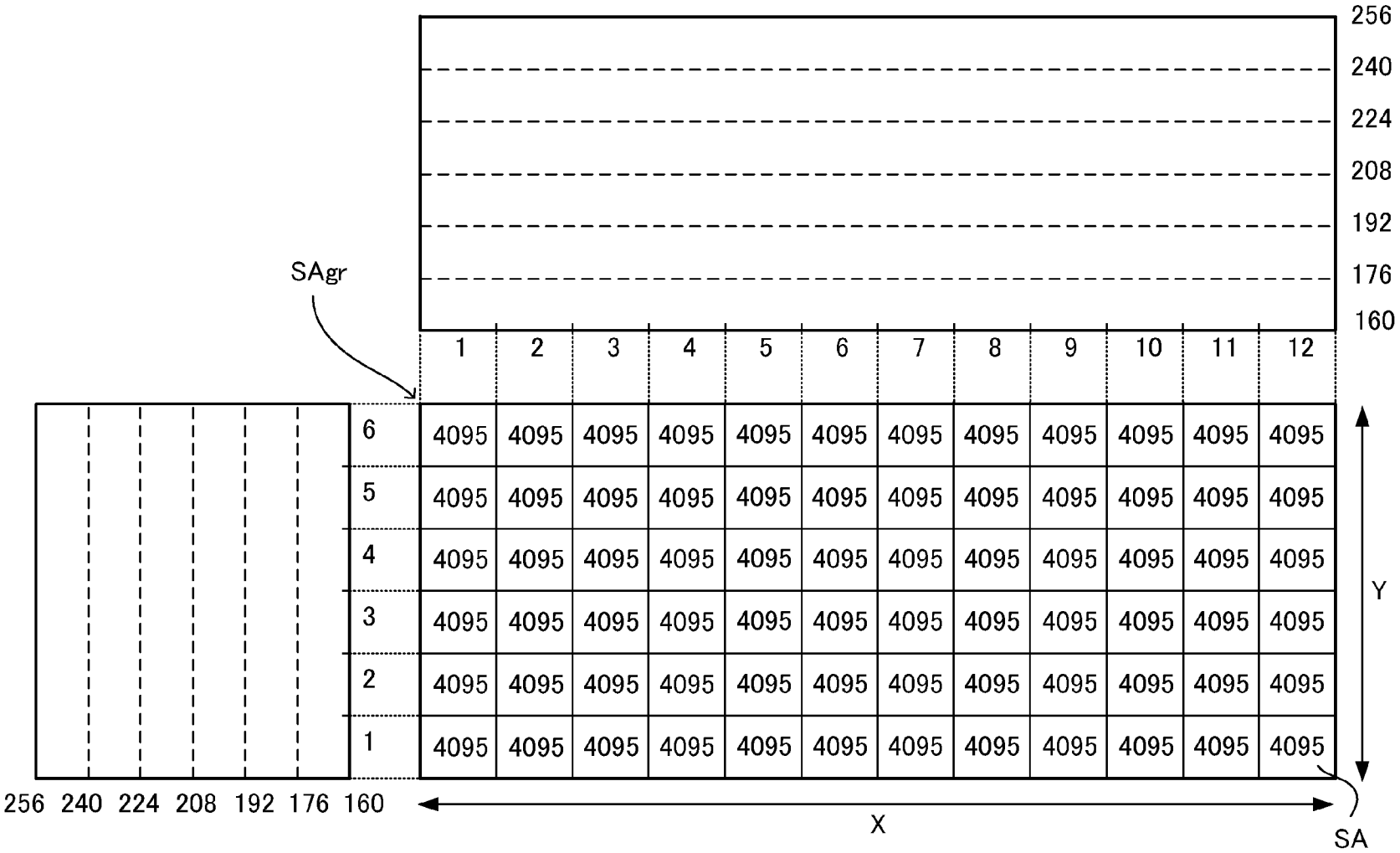
FIG. 2 An illustration diagram, in which, when all LEDs where 12 LEDs are arranged in an X direction and 6 LEDs are arranged in a Y direction emit light according to a PWM value (for example, 4095), the PWM value is made to correspond to the illumination regions of the individual LEDs.

The brightness correction portion 21 corrects the brightness distribution of the planar light in consideration of the visual characteristic of humans. The visual characteristic will first be described. For example, when all the LEDs 52 in which 12 LEDs 52 are aligned in the X direction and 6 LEDs 52 are aligned in the Y direction emit light according to the PWM value (for example, 4095), FIG. 2 is obtained by drawing a diagram while the PWM value is made to correspond to the illumination regions SA (72 (=12×6) illumination regions SA so as to correspond to the number of LEDs 52) of the individual LEDs 52.

Figure 3:
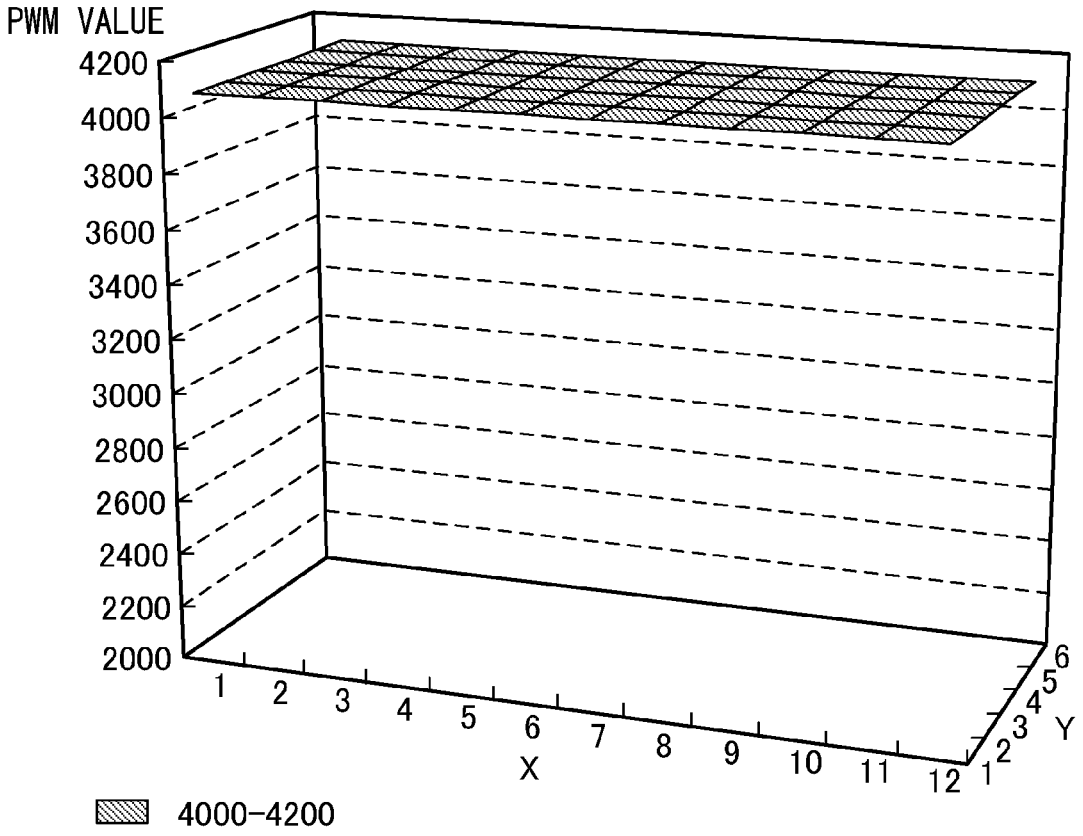
FIG. 3 A contour line diagram showing, in a contour manner, the illumination regions and the PMW value.

FIG. 3 is a diagram showing, in a contour manner, the illumination regions SA and the PMW value (the PWM value shown in the figure is obtained by illustrating one LED chip 53; for convenience, a description will be given assuming that the PWM values corresponding to the remaining LED chips 53 are equal to the value shown in the figure).

When the vicinity of the center of the planar light obtained by connecting all the illumination regions SA is viewed by a person, if the vicinity of the center has a sufficient brightness, the person feels that the planar light does not include variations in the brightness and has a constant brightness even if the other regions have a lower brightness than the vicinity of the center.

Then, since the planar light on the entire illumination region SAgr maintains a constant brightness or more, it is not necessary that even illumination regions SA in the perimeter of the entire illumination region SAgr be equal in brightness to the illumination regions SA around the center of the entire illumination region SAgr. Hence, the brightness correction portion 21 performs correction processing (brightness correction processing) for achieving the brightness distribution in which the brightness of the illumination regions SA in the perimeter of the entire illumination region SAgr is lower than that of the illumination regions SA around the center.

For example, the brightness correction portion 21 has a filter FT (X, Y) formed by aligning, in the X direction and the Y direction, coefficients (for example, values of 8 bits=0 to 255; filter values) necessary for changing the PWM value, and performs a correction on the PWM value with a computation using the filter FT (X, Y) (since the brightness correction processing is not performed on the PWM value shown in FIG. 2, in two diagrams showing the filter values of the filter FT (X, Y) in the individual directions (the X direction and the Y direction), plot points are not shown).

Specifically, as shown in FIG. 1, the brightness correction portion 21 includes, in the X direction, a filter memory 22 (X) that stores a filter FT-R (X) corresponding to the red light emitting LED chip 53R, a filter FT-G (X) corresponding to the green light emitting LED chip 53G and a filter FT-B (X) corresponding to the blue light emitting LED chip 53B.

The brightness correction portion 21 includes, in the Y direction, a filter memory 22 (Y) that stores a filter FT-R (Y) corresponding to the red light emitting LED chip 53R, a filter FT-G (Y) corresponding to the green light emitting LED chip 53G and a filter FT-B (Y) corresponding to the blue light emitting LED chip 53B.

The light emission power correction portion 23 includes a light emission power calculation circuit 24 and a light emission power limitation circuit 25. The light emission power calculation circuit 24 calculates, for example, the light emission power (consumption power) of the LEDs 52 corresponding to the individual illumination regions SA based on the light source color video signals on which the brightness correction portion 21 has performed the brightness correction processing, and thereby performs light emission power calculation processing for calculating the total light emission power of the LEDs 52 corresponding to the entire illumination region SAgr.

When the total light emission power calculated by the light emission power calculation circuit 42 exceeds a predetermined allowable light emission power, the light emission power limitation circuit 25 performs light emission power correction processing for limiting the light emission power of the individual LEDs 52 such that the total light emission power is within the predetermined allowable light emission power.

The P/S conversion portion 37 converts, into serial data, the light source color video signal that is transmitted in the form of parallel data and that has been subjected to various types of correction processing (such as the brightness correction processing and the light emission correction processing).

The LED driver 45 controls the lighting of the LEDs 52 based on the signals (PWM signal and the timing signal) from the LED controller 13.

As described above, the LED 52 includes one LED chip 53R, two LED chips 53G and one LED chip 53B. The lighting of these LED chips (light emitting chips) 53 is controlled by the LED driver 45 using the pulse width modulation method.

Here, the brightness correction processing will now be described. The brightness correction processing on the light source color video signals (RSd, GSd and BSd) using the filter FT (X, Y) at the brightness correction portion 21 will be specifically described with reference to not only FIGS. 1 to 3 but also FIGS. 4 to 13. The light source color video signals (intermediate light source control data) that have been subjected to the brightness correction processing are represented by a light source red video signal RSd', a light source green video signal GSd' and a light source blue video signal BSd' (in other words, "'" is added to the signals that have been subjected to the brightness correction processing).

In the description given with reference to FIGS. 4 to 13, as with FIGS. 2 and 3, the PWM value shown in the figures is obtained by illustrating one LED chip 53; for convenience, a description will be given assuming that the PWM values corresponding to the remaining LED chips 53 are equal to the value shown in the figures.

Figure 4:
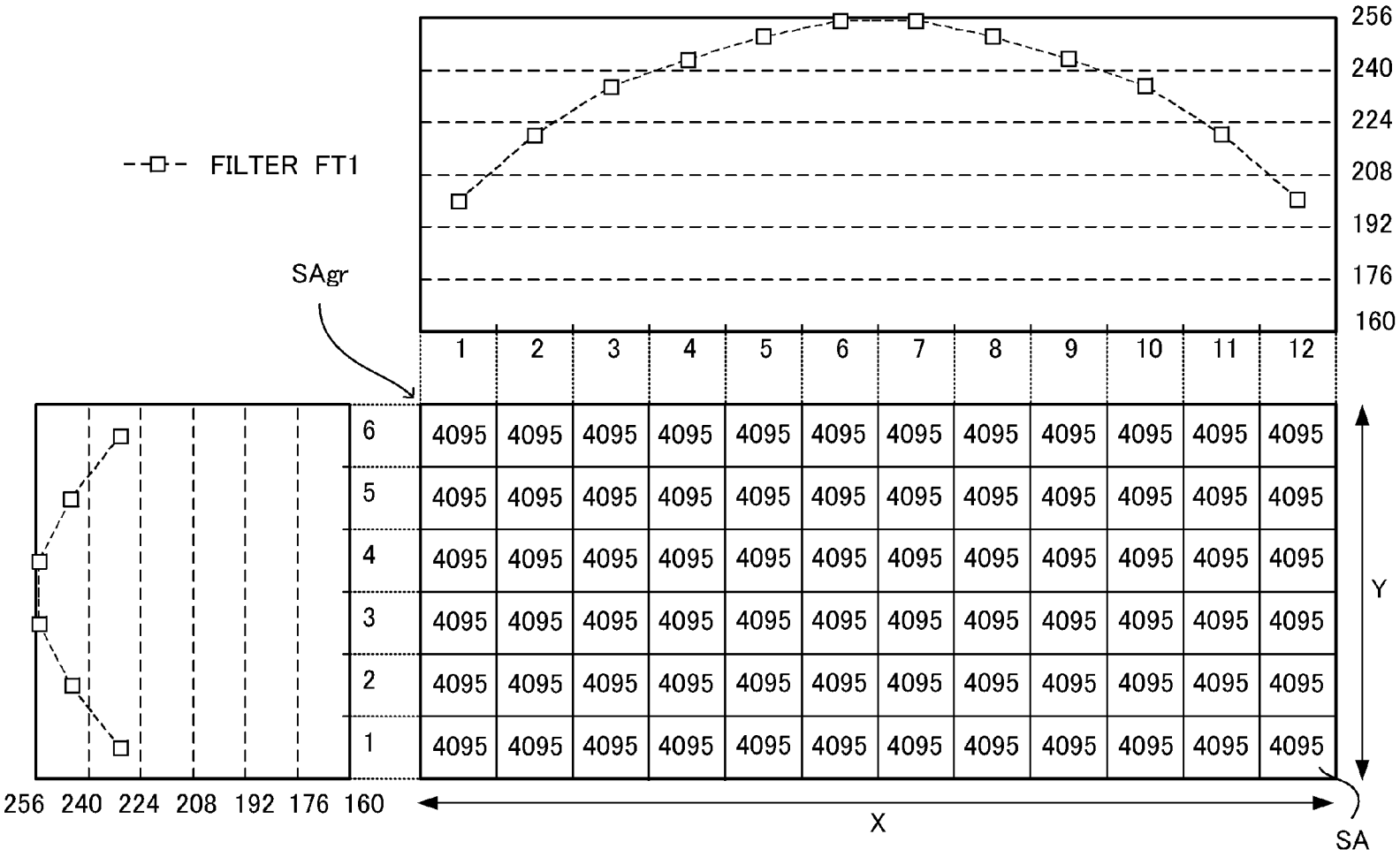
FIG. 4 An illustration diagram, in which, while the PWM value (for example, 4095) is made to correspond to the illumination regions of the individual LEDs, the filter values of a filter FT1 (X, Y) in the X direction and Y direction are plotted according to the illumination regions.
Figure 6:
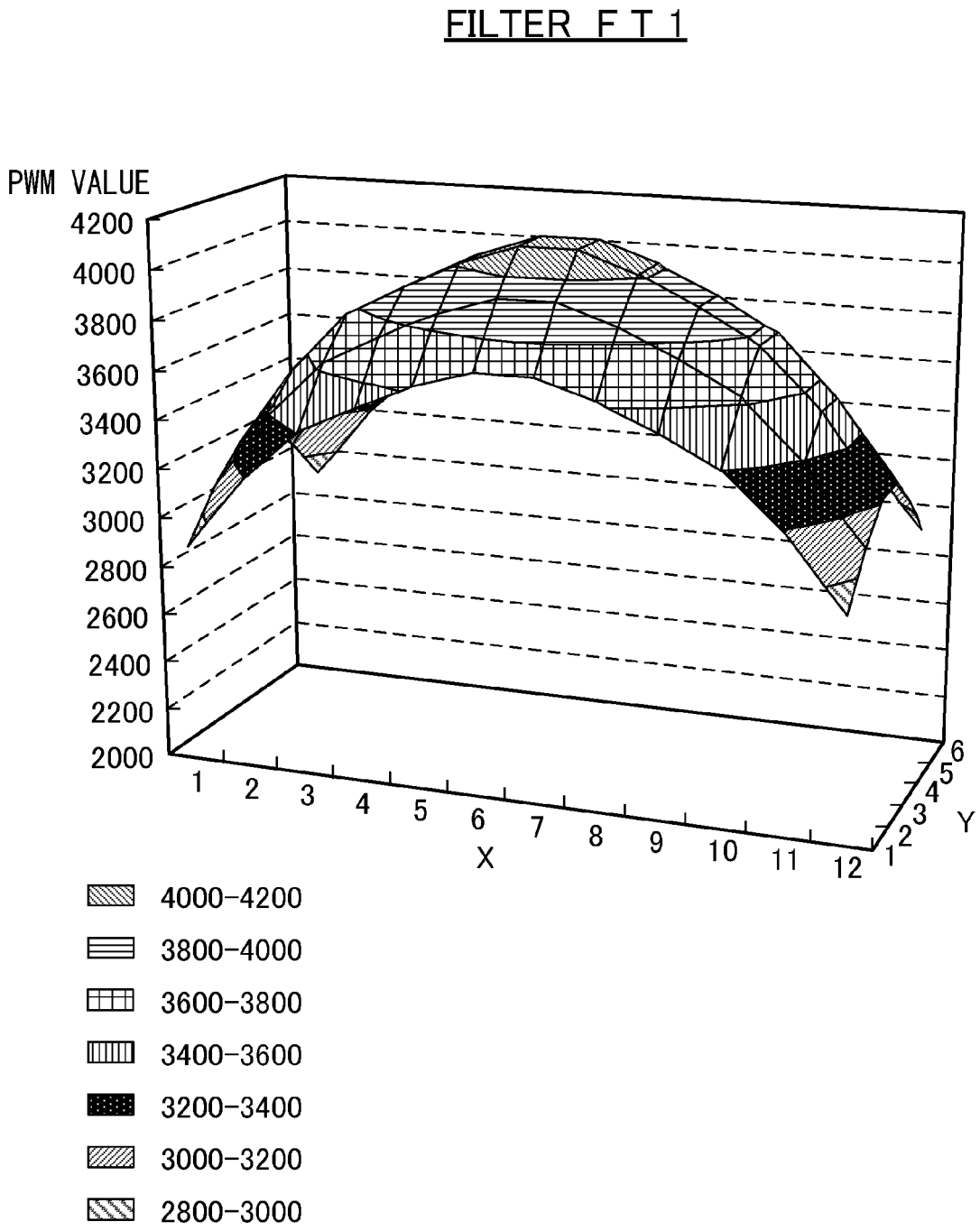
FIG. 6 A contour line diagram showing, in a contour manner, the PWM value after the brightness correction processing corresponding to the X direction and the Y direction has been completed with the filter FT1 (X, Y) and the illumination regions.
Figure 7:
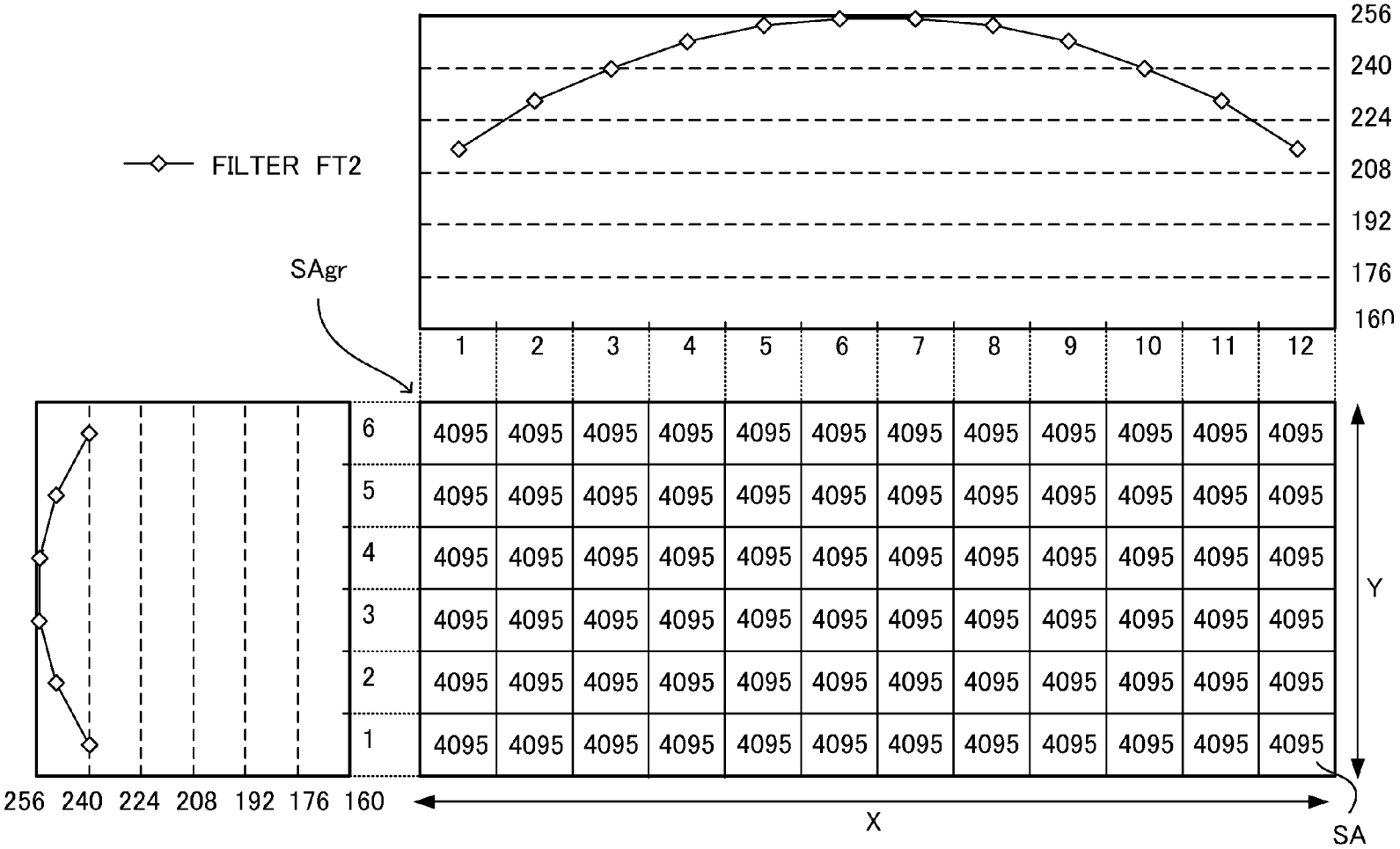
FIG. 7 An illustration diagram, in which, while the PWM value (for example, 4095) is made to correspond to the illumination regions of the individual LEDs, the filter values of a filter FT2 (X, Y) in the X direction and Y direction are plotted according to the illumination regions.
Figure 8:
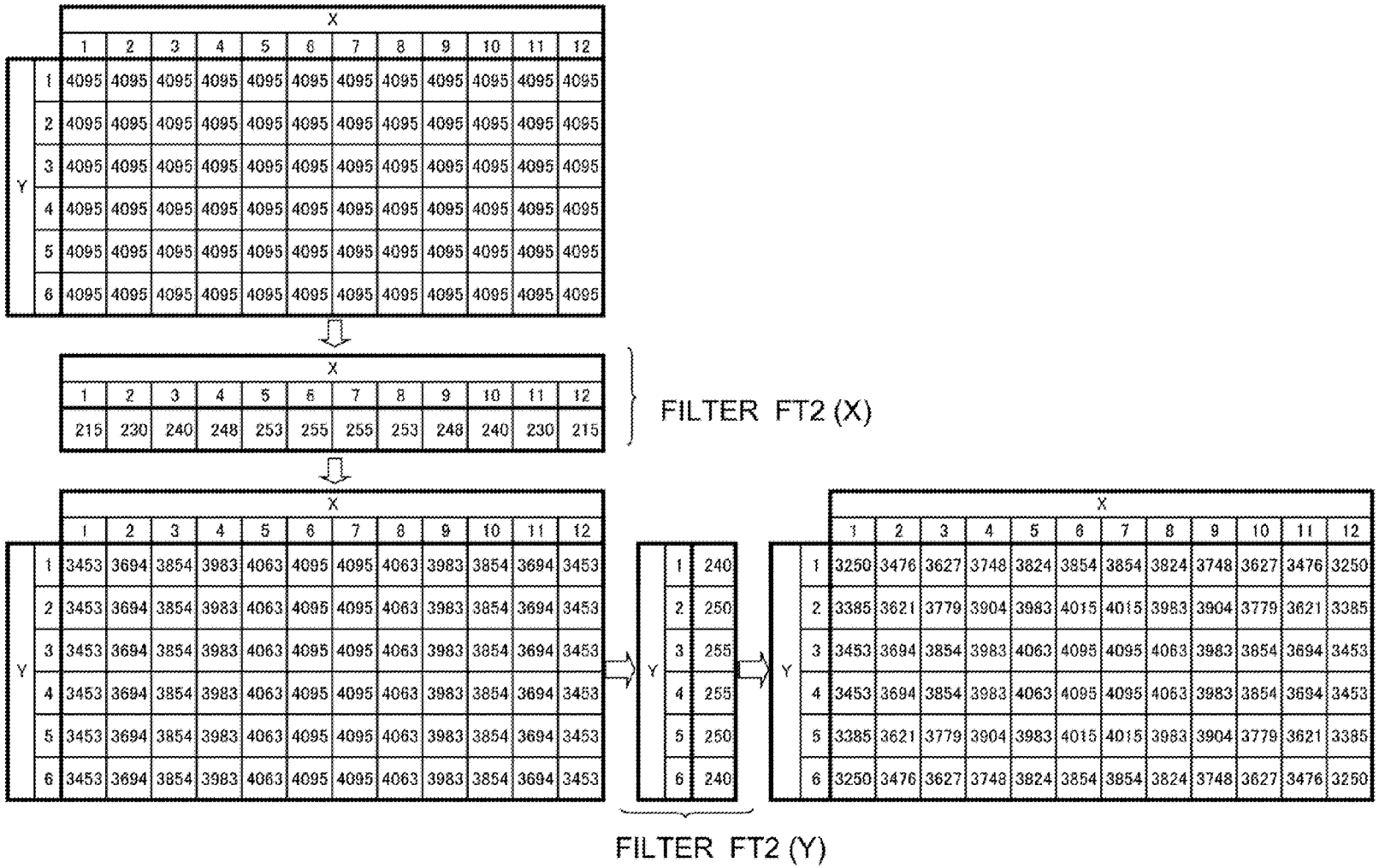
FIG. 8 An illustration diagram showing a process in which the brightness correction processing is temporarily performed, with the filter FT2 (X) in the X direction, on the LEDs that emit light with a PWM value of 4095, and in which furthermore, the brightness correction processing is performed, with the filter FT2 (Y) in the Y direction.
Figure 9:
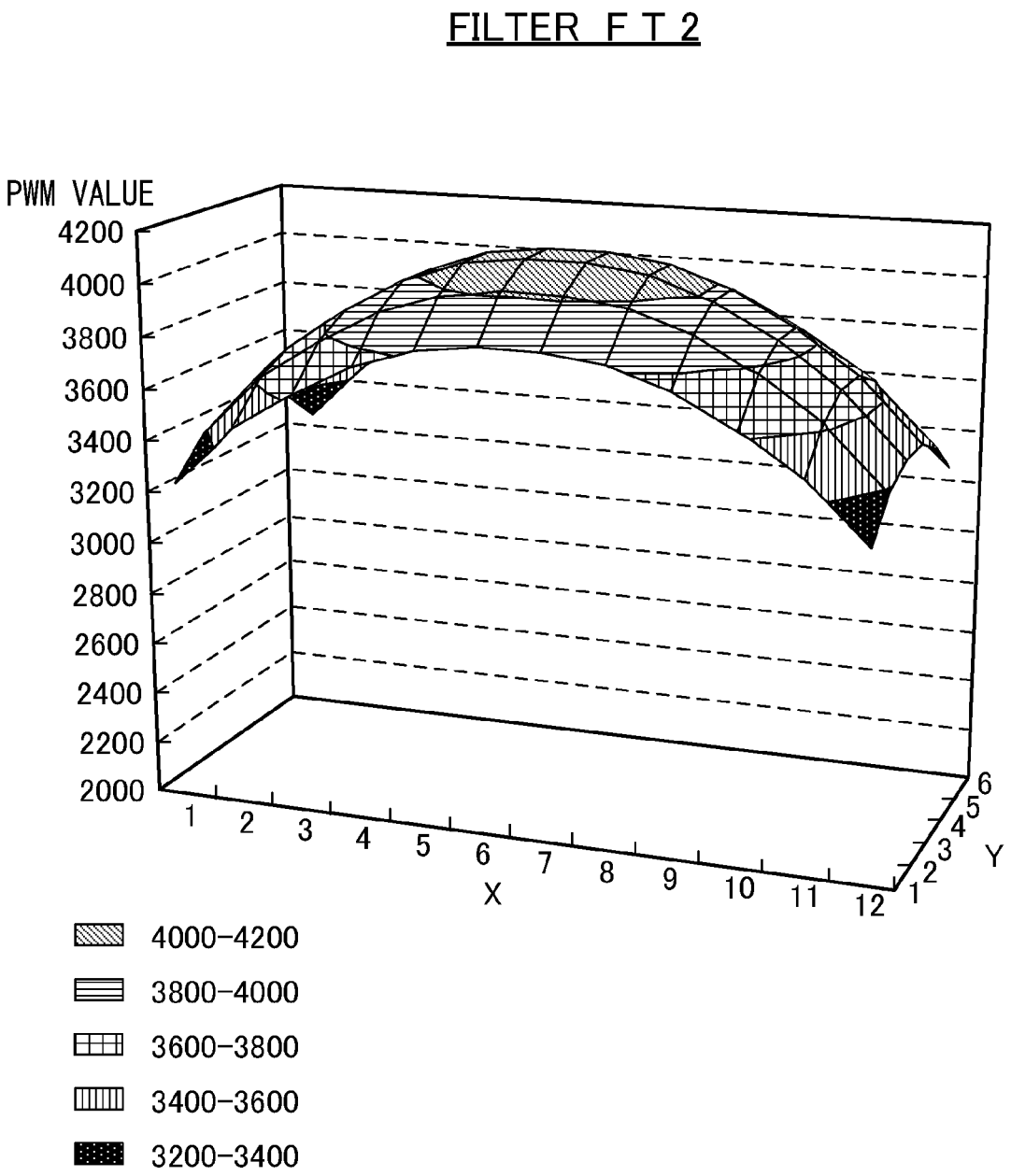
FIG. 9 A contour line diagram showing, in a contour manner, the PWM value after the brightness correction processing corresponding to the X direction and the Y direction has been completed with the filter FT2 (X, Y) and the illumination regions.
Figure 10:
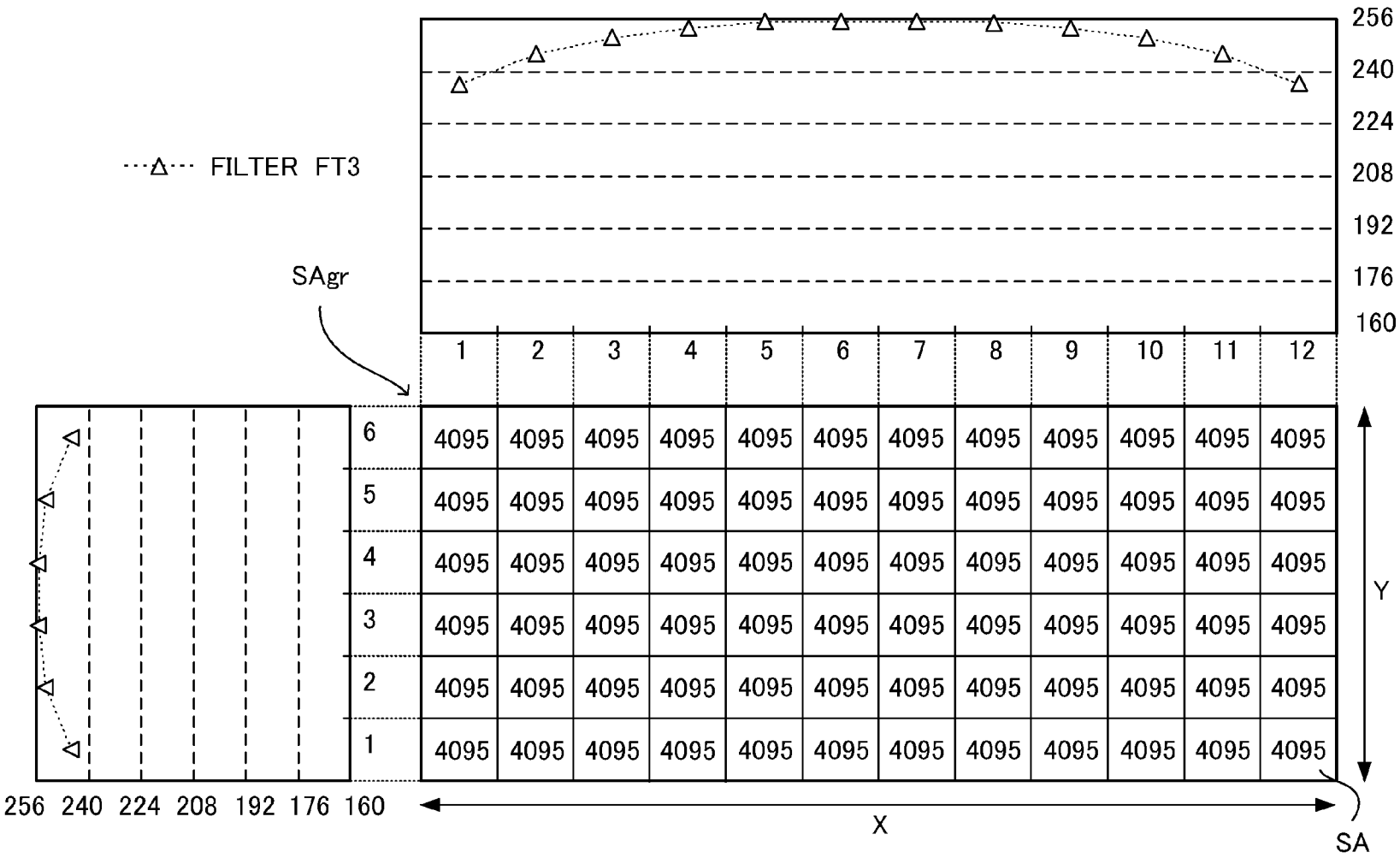
FIG. 10 An illustration diagram, in which, while the PWM value (for example, 4095) is made to correspond to the illumination regions of the individual LEDs, the filter values of a filter FT3 (X, Y) in the X direction and Y direction are plotted according to the illumination regions.
Figure 11:
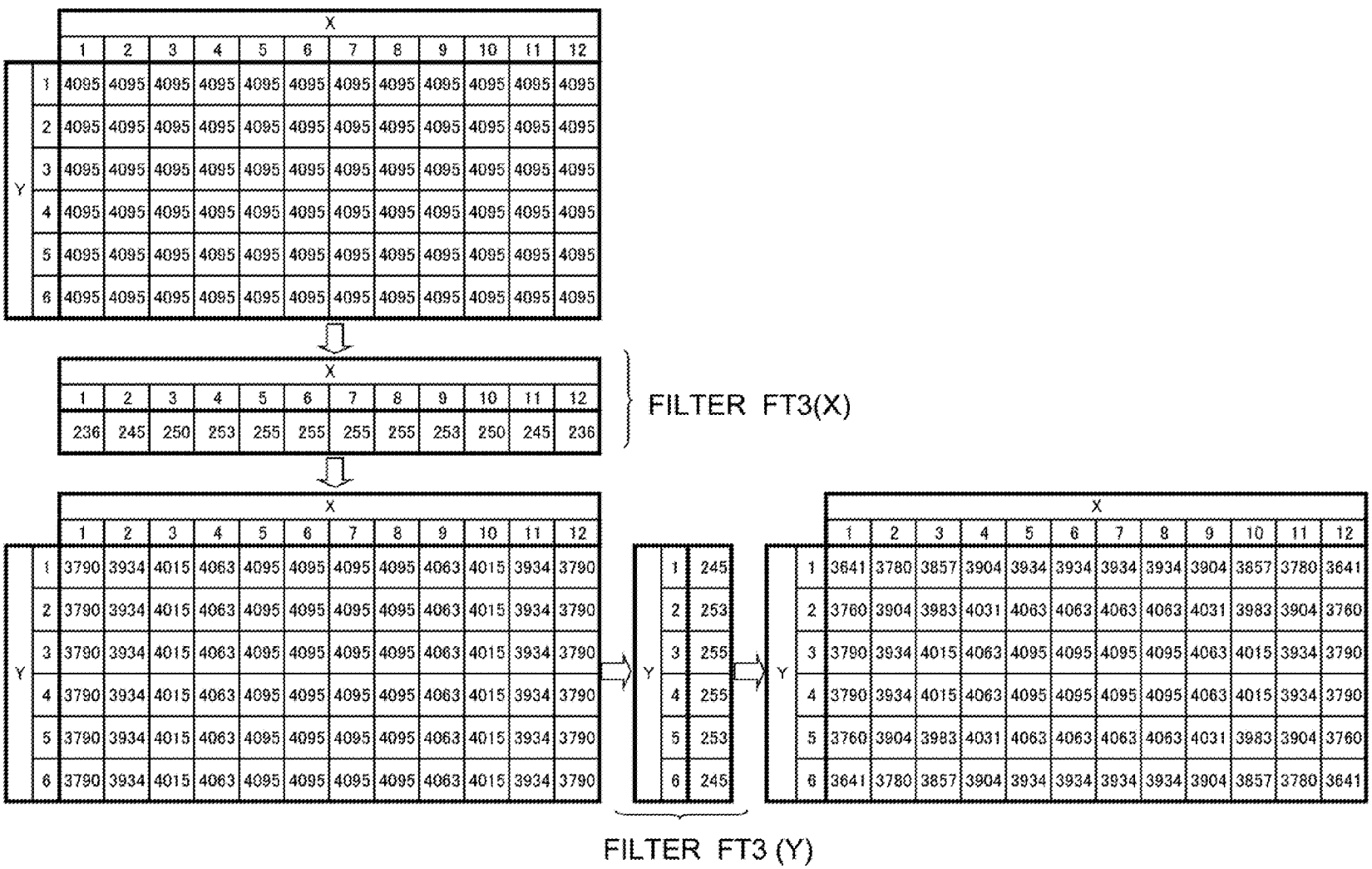
FIG. 11 An illustration diagram showing a process in which the brightness correction processing is temporarily performed, with the filter FT3 (X) in the X direction, on the LEDs that emit light with a PWM value of 4095, and in which furthermore, the brightness correction processing is performed, with the filter FT3 (Y) in the Y direction.
Figure 12:
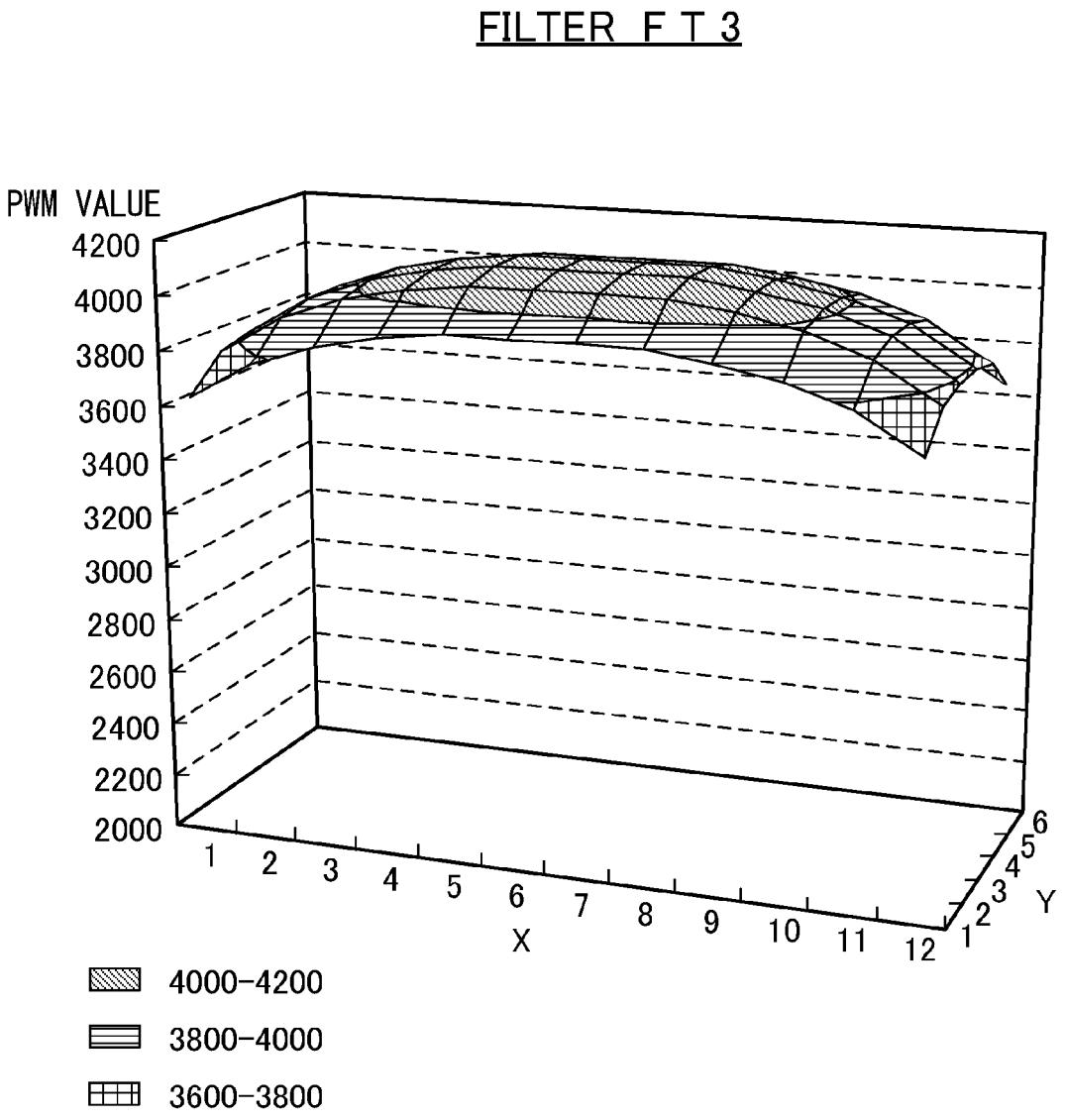
FIG. 12 A contour line diagram showing, in a contour manner, the PWM value after the brightness correction processing corresponding to the X direction and the Y direction has been completed with the filter FT3 (X, Y) and the illumination regions.

There are a plurality of types of filters FT (X, Y); FIGS. 4 to 6 are related to a filter FT1 (X, Y) (brightness correction (high) type); FIGS. 7 to 9 are related to a filter FT2 (X, Y) (brightness correction (medium) type); FIGS. 10 to 12 are related to a filter FT3 (X, Y) (brightness correction (low) type).

Each of the filters FT1 (X, Y) to FT3 (X, Y) is present according to the LED chips 53R, 53G and 53B. For example, the filter FT1 (X, Y) corresponding to the LED chip 53R is represented by FT1 R-(X) and FT1 R-(Y).

Figure 13:
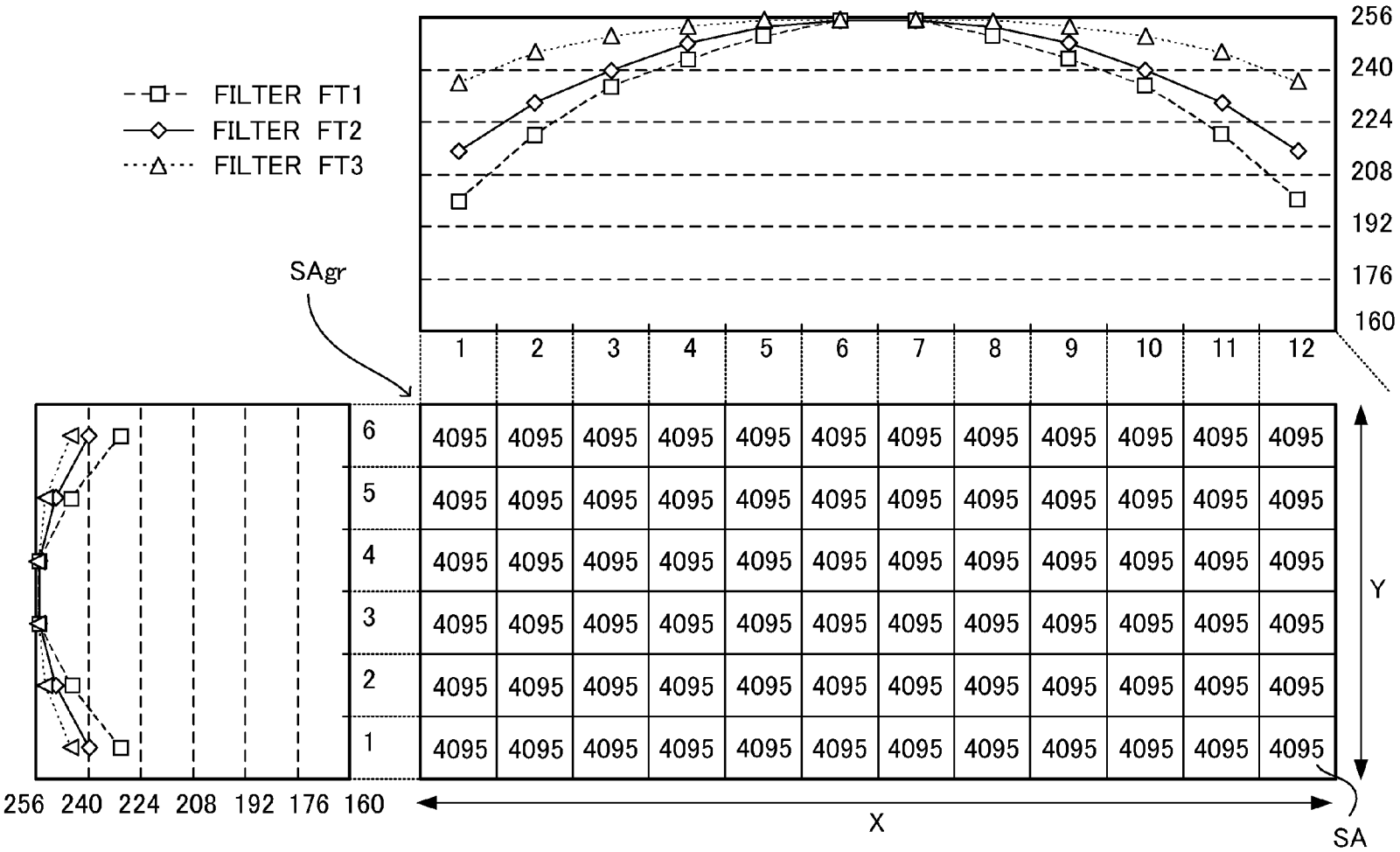
FIG. 13 An illustration diagram, in which, while the PWM value (for example, 4095) is made to correspond to the illumination regions of the individual LEDs, the filter values of the filters FT1 (X, Y) to FT3 (X, Y) in the X direction and Y direction are plotted according to the illumination regions.

In FIGS. 4, 7 and 10, as in FIG. 2, while the PWM value (for example, 4095) is made to correspond to the illumination regions SA of the individual LEDs 52, the filter values of the filter FT (X, Y) in the X direction and Y direction are plotted according to the illumination regions SA. FIG. 13 is an illustration diagram in which the filter values of all the filters FT (X, Y), that is, the filters FT1 (X, Y) to FT3 (X, Y) are shown together.

As understood from the filter values of the filter FT (X) in the X direction of FIG. 13, all the filters FT (X) have filter values such that filter values around both ends in the X direction are lower than those around the center (in other words, the filter values around the center in the X direction are higher than those around both ends). Hence, when these filter values are continuously aligned in the order in which the illumination regions SA are aligned in the X direction, a graph line in the shape of a mountain is competed.

Likewise, as understood from the filter values of the filter FT (Y) in the Y direction of FIG. 13, all the filters FT (Y) have filter values such that filter values around both ends in the Y direction are lower than those around the center. Hence, when these filter values are continuously aligned in the order in which the illumination regions SA are aligned in the Y direction, a graph line in the shape of a mountain is competed.

FIGS. 5, 8 and 11 show a process in which the brightness correction processing is temporarily performed, with the filter FT (X) in the X direction, on the LEDs 52 which emit light with a PWM value of 4095, and in which furthermore, the brightness correction processing is performed, with the filter FT (Y) in the Y direction, on the LEDs 52 (the correction processing proceeds along arrows).

FIGS. 6, 9 and 12 show, in a contour manner, the PMW values (that is, the light source color video signals (RSd', GSd' and BSd')) on which the brightness correction processing has been completed according to the X direction and the Y direction shown in FIGS. 4, 7 and 10 and the illumination regions SA.

A description will be given with reference to the drawings described above. As shown in FIGS. 5, 8 and 11, the brightness correction portion 21 performs, with the filter FT (X), the brightness correction processing on the PMW value (the light source color video signals RSd, GSd and BSd) which is transmitted from the aging correction portion 36 and on which the brightness correction processing has not been performed. Specifically, the brightness correction processing is performed according to the following formula (a value of 255 mentioned below means the maximum filter value).

PWM value before brightness correction processing× filter value of filter $FT(X)/255$=PWM value after brightness correction processing in the $X$ direction Then, after the brightness correction processing in the X direction, the brightness correction portion 21 performs the brightness correction processing in the Y direction. Specifically, the brightness correction processing is performed according to the following formula.

PWM value after brightness correction processing using filter $FT(X)$×filter value of filter $FT(Y)/255$=PWM value after brightness correction processing in the $X$ direction and the $Y$ direction A specific example will be described below. For example, when the brightness correction portion 21 uses the filter FT1 (X, Y) (brightness correction (high) type) shown in FIG. 5, brightness correction processing is performed as follows, with a filter value of "200" in the first column of the filter FT1 (X), on a PWM value of "4095" in the illumination region SA in the first row and the first column of the matrix arrangement (see the PWM value after the brightness correction processing indicated by an arrow extending from the filter FT1 (X).

$$4095\times200/255\cong3212$$

The brightness correction processing is further performed as follows, with a filter value of "230" in the first row of the filter FT1 (Y), on the PWM value after the brightness correction processing in the X direction that has been changed into a value of "3212" in the illumination region SA in the first row and the first column of the matrix arrangement (see the PWM value after the brightness correction processing indicated by an arrow extending from the filter FT1 (Y).

$$3212\times230/255\cong2897$$

FIGS. 6, 9 and 12 are diagrams showing, in a contour manner, the results of the brightness correction processing in the X direction and the Y direction described above that has been performed according to the individual illumination regions SA. Hence, FIGS. 6, 9 and 12 are compared with FIG.

3 that shows, in a contour manner, the illumination regions SA and the PWM value on which the brightness correction processing has not been performed.

Then, FIGS. 6, 9 and 12 are approximately equal to FIG. 3 in the brightness of the illumination regions SA around the center of the entire illumination region SAgr after the brightness correction processing. On the other hand, the illumination regions SA in the perimeter of the entire illumination region SAgr after the brightness correction processing in FIGS. 6, 9 and 12 are lower in brightness than those in FIG. 3.

In other words, when, in each of the directions (the two directions, that is, the X direction and the Y direction), the brightness correction processing is performed with the filter FT (X, Y) in which filter values around both ends in each of the directions are lower than those around the center, the brightness distribution in which the brightness of the illumination regions SA in the perimeter of the entire illumination region SAgr is lower than that of the illumination regions SA around the center is realized (when the LED 52 includes the LED chips 53R, 53G and 53B, variations in colors are also removed).

The summary of what has been described above is as follows. Specifically, under the management of the main micon 12, the brightness correction portion 21 of the LED controller 13 receives the light source color video signals (RSd, GSd and BSd) based on the basic color video signals (however, as shown in FIG. 1, the light source color video signals may be subjected to correction processing, other than the brightness correction processing, performed by the individual variation correction portion 33, the temperature correction portion 35 and the aging correction portion 36).

Then, under the management of the main micon 12, the LED controller 13 (that is, the micon unit 11) performs, along, for example, the two directions (for example, the X direction and the Y direction) within the plane of the planar light formed with the LEDs 52 arranged in a matrix, the brightness correction processing for adjusting the brightness distribution of the planar light on the light source color video signals (RSd, GSd and BSd), and thereby changes them into the light source color video signals (RSd', GSd' and BSd').

If the light source color video signals (RSd', GSd' and BSd') described above are transmitted through the P/S conversion portion 37 to the LED driver 45 without passing through the light emission power correction portion 23, the following operation is performed.

Specifically, for example, when the LEDs 52 corresponding to the entire illumination region SAgr emit light according to a PWM value of "4095" (the light source color video signals (RSd, GSd and BSd)), the light is emitted according to the PWM values (light source color video signals (RSd', GSd' and BSd')) after the brightness correction processing corresponding to the two directions shown in FIGS. 6, 9 and 12.

Since, in particular, the brightness correction processing is performed along the two directions, that is, the X direction and the Y direction, the brightness correction processing is two-dimensionally performed on the planar light. Hence, the shape of the brightness distribution of the planar light varies as compared with, for example, the planar light on which one-dimensional (along only one direction) brightness correction processing has been performed. An example thereof is the brightness distribution shown in FIGS. 6, 9, 12 or the like.

In other words, the brightness correction processing is performed by the micon unit 11 such that, in each of the directions (the X direction and the Y direction), the brightness around both ends in the direction is lower than that around the center. Then, the brightness around the center of the entire illumination region SAgr is not significantly changed after the brightness correction processing whereas the brightness in the perimeter of the entire illumination region SAgr other than the vicinity of the center is lowered after the brightness correction processing as compared with the brightness before the brightness correction processing.

Even when the brightness in the perimeter of the entire illumination region SAgr is relatively lowered, the brightness around the center of the entire illumination region SAgr is sufficiently high. Hence, due to the visual characteristic of humans, a viewer feels that the entire illumination region SAgr (that is, the planar light) does not include variations in brightness and has a constant brightness.

Not only the viewer feels that the planar light does not include variations in brightness, but also the light emission power (consumption power) of the LEDs 52 that generate the planar light having the brightness distribution which makes humans feel no variations in brightness is reduced. In other words, the light emission power of the LEDs 52 when the brightness correction processing is performed is lower than the light emission power of the LEDs 52 when the brightness correction processing is not performed.

Hence, the backlight unit (therefore, the liquid crystal display device 89) having the brightness correction processing function described above is driven with a low light emission power. In the liquid crystal display device 89 incorporating the backlight unit 69, the light emission power is reduced without the image quality being reduced. The micon unit 11 changes the brightness of the LEDs 52 in each of the directions (the X direction and the Y direction). Hence, the micon unit 11 can reduce control burden as compared with a micon unit that changes the brightness of its light sources based on, for example, the result of analysis of image data corresponding to each of the light sources.

The light emission power correction processing will now be described. For ease of understanding, an example where the light emission power correction processing is performed without the brightness correction processing being performed will first be described. Specifically, the light source color video signals (RSd, GSd and BSd) that have passed through the aging correction portion 36 are subjected to the light emission power correction processing in the light emission power correction portion 23 without passing through the brightness correction portion 21, and are thereafter transmitted through the P/S conversion portion 37 to the LED driver 45.

The light emission power of the backlight unit 69 is proportional to the PWM value. Hence, for convenience, a description will be given while a PWM value of "4095" is represented by a light emission power value of "100%." Hence, the table of the PWM value and the illumination regions SA of the individual LEDs 52 shown in FIG. 2 is shown as FIG. 14A. When the backlight unit 69 emits light as shown in FIG. 14A, the total light emission power becomes 7200%.

As an example of the allowable light emission power, in a case where, as shown in FIG. 14A, the backlight unit 69 emits light at 100% according to the liquid crystal display panel 79 of a full-screen white display, a case where the light emission power of the backlight unit 69 is limited, as shown in FIG. 14B, to 50% with respect to the light emission power (100%) which can be supplied (the total light emission power: 3600%) is assumed. Specifically, as shown in FIG. 14B, the light emission power of the LEDs 52 corresponding to the individual illumination regions SA is limited to 50% with respect to the maximum light emission power. In other words, the PWM value (duty ratio) of the individual LEDs 52 is limited to 50% (in the following description, for convenience, the individual LED chips 53 included in the LED 52 are assumed to be controlled with the same PWM value).

As an example of the distribution of the light emission power of the LEDs 52 corresponding to the entire illumination region SAgr on which the light emission power correction processing is performed, there is a case shown in FIG. 14C (the total light emission power; 4800%). The distribution of the light emission power is determined by the video signal processing portion 42 based on the basic video signals (FRS, FGS and FBS) (in short, based on the basic video signals (FRS, FGS and FBS), the light source color video signals (RSd, GSd and BSd) are determined). As shown in FIG. 14C, three PWM values of 0%, 50% and 100% constitute the distribution of the light emission power of the entire illumination region SAgr.

A specific description will be given below. When the light emission power correction processing is performed without the brightness correction processing being performed, the light emission power calculation circuit 24 of the light emission power correction portion 23 performs light emission calculation processing for calculating, for example, the light emission power of the LEDs 52 corresponding to the individual illumination regions SA from the light source color video signals (RSd, GSd and BSd) passing through the aging correction portion 36 and then calculating the light emission power (the total light emission power) of the LEDs 52 corresponding to the entire illumination region SAgr.

Then, as a result of the light emission power calculation processing, when, as shown in FIG. 14C, the total light emission power is 4800% (when the average value of the LEDs 52 corresponding to the individual illumination regions SA is about 66.7%), since it exceeds an allowable light emission power of 3600% (the average value of the LEDs 52 corresponding to the individual illumination regions SA is 50%; see FIG. 14B), the light emission power limitation circuit 25 limits the light emission power.

The light emission power limitation circuit 25 first calculates, for the total light emission power, a rate of limitation $\alpha$ that is a scaling factor of the predetermined allowable light emission power. Specifically, when, as shown in FIG. 14C, the total light emission power is 4800%, the light emission power limitation circuit 25 calculates 3600/4800 (50/66.7) and thereby calculates that the rate of limitation $\alpha$ is 0.75. Then, the light emission power limitation circuit 25 limits (corrects) the light emission power of the individual LEDs 52 by multiplying the light emission power of the LEDs 52 corresponding to the individual illumination regions SA by the rate of limitation $\alpha$.

For example, when, as shown in FIG. 14C, the light emission power of the LEDs 52 corresponding to the entire illumination region SAgr attempts to be consumed, as shown in FIG. 14D, the light emission power limitation circuit 25 limits the light emission power of the LEDs 52 corresponding to the illumination regions SA. Specifically, the processing is performed by the light emission power limitation circuit 25, and thus the total sum of the light emission power of the LEDs 52 corresponding to the individual illumination regions SA becomes 3600%, that is, becomes equal to the predetermined allowable light emission power.

As described above, the light emission power correction processing is performed by the light emission power correction portion 23, and thus a PWM value of 50% shown in FIG. 14C is limited to 37.5%, and a PWM value of 100% shown in FIG. 14C is limited to 75%; however, the difference between the PWM values of the LEDs 52 corresponding to the individual illumination regions SA is maintained. Hence, in the light emission power correction processing, the total light emission power of the backlight unit 69 is reduced within the predetermined allowable light emission power range (3600%), and it is possible to set the light emission power of the LEDs 52 corresponding to the individual illumination regions SA, according to image data on the individual illumination regions SA.

Consequently, the backlight unit 69 can supply the amount of light that is within the predetermined allowable light emission power range but is different between the individual illumination regions SA, and the liquid crystal display panel 79 receiving the amount of light can display an image having a peak brightness.

The PWM values of the LEDs 52 corresponding to the individual illumination regions SA shown in FIGS. 14A to 14D are obtained by illustrating one LED chip 53, and the light emission power correction processing discussed above has been described based on one LED chip 53. Hence, the PWM values corresponding to the remaining LED chips 53 can be described assuming that they are the same values shown in the figures.

Examples of formulas related to the calculation of the light emission power of the LEDs 52 including a plurality of LED chips 53 are given below.

light emission power amount (%) necessary for red light emission (*R* light emission power amount (%))=the total sum of the PWM values of the red LED chip 53*R* corresponding to the individual illumination regions *SA* (formula 1)

light emission power amount (%) necessary for green light emission (*G* light emission power amount (%))=the total sum of the PWM values of the green LED chip 53*G* corresponding to the individual illumination regions *SA* (formula 2)

light emission power amount (%) necessary for blue light emission (*B* light emission power amount (%))=the total sum of the PWM values of the blue LED chip 53*B* corresponding to the individual illumination regions *SA* (formula 3)

light emission power value of all LEDs 52 (the total light emission power)=*R* light emission power amount+*G* light emission power amount+*B* light emission power amount (formula 4)

the rate of limitation $\alpha$=the allowable light emission power/the total light emission power (formula 5)

the limited total light emission power (the limited total light emission power=the allowable light emission power)=(*R* light emission power amount+*G* light emission power amount+*B* light emission power amount)×$\alpha$ (formula 6)

Specifically, when the light emission power calculation circuit 42 calculates the total light emission power of all the LEDs 52, the light emission power calculation circuit 42 calculates the light emission power amount of the LED chip 53 of each of the light emission colors (formulas 1 to 3) from the total sum of the light emission power of the individual light emission colors (in short, the LED chips 53 of the individual colors of the individual LEDs 52) on the individual illumination regions SA, and calculates the total light emission power of all the LEDs 52 from the total sum of the light emission power amounts of the LED chips of the individual light emission colors (formula 4). Then, the light emission power limitation circuit 43 multiplies the light emission power of the LED chip 53 of each of the light emission colors by the same rate of limitation $\alpha$, and thereby limits the light emission power on the individual illumination regions SA (formula 6).

The light emission power correction processing is performed in this way, and thus while variations in the color tone of the LED 52 including the LED chips 53R, 53G and 53B having different light emission colors are being reduced, the light emission power of the LED 52 is reduced.

However, the present invention is not limited to the multiplying of the light emission power of the LED chips 53 of the individual light emission colors by the same rate of limitation α, as described above. Specifically, a different rate of limitation α may be set according to the light emission power of each of the light emission power colors (in other words, the formula for calculating the limited light emission power when the rate of limitation α for the LED chips 53R, 53G and 53B is the same is formula 6).

Although, as described above, the example where, when the total light emission power is calculated, the total light emission power (light emission power amount) of the LED chips 53 of the individual colors is calculated (see formulas 1 to 4) has been described, the present invention is not limited to this example. For example, the light emission power of the LEDs 52 (all the LED chips 53 included in one LED 52) corresponding to the individual illumination regions SA is totalized for the entire illumination region SAgr, and thus the total light emission power of the LEDs 52 corresponding to the entire illumination region SAgr may be calculated.

In short, the total light emission power can be preferably calculated based on the PWM values of the LEDs 52 (specifically, the individual LED chips 53 in the LEDs 52) corresponding to the individual illumination regions SA. In other words, the total light emission power of all the LEDs 52 can be preferably calculated from the sum of the light emission power of the individual LEDs 52.

Here, while the case where the brightness correction processing and the light emission power correction processing are individually performed as described above is being referenced as a comparative example, a case where the light emission power correction processing is performed after the brightness correction processing will be described with reference to FIGS. 15 and 16A to 16E.

Figure 15:
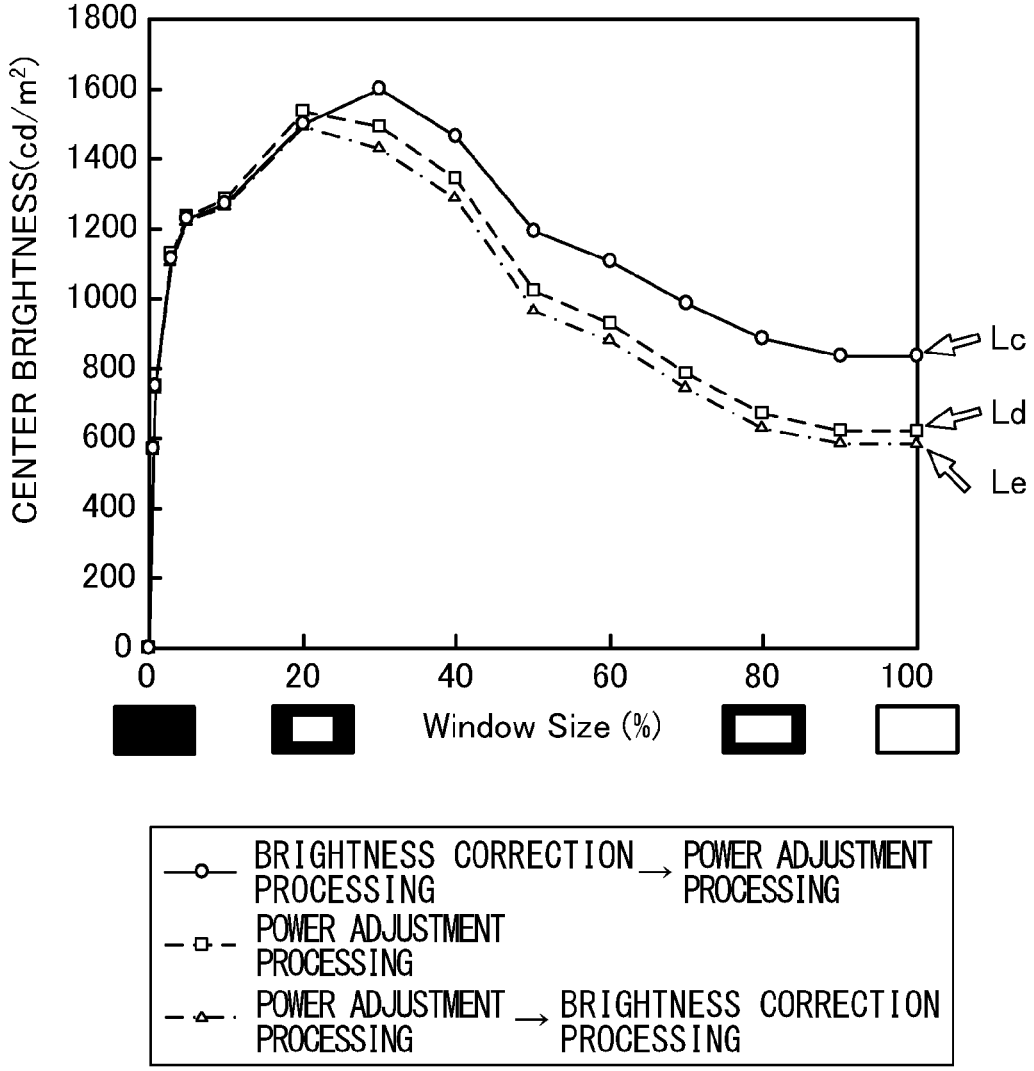
FIG. 15 A diagram showing a center brightness corresponding to the ratio of a screen size used in a liquid crystal display panel, for each of various types of processing.

FIG. 15 is a diagram showing a center brightness corresponding to the ratio of a screen size (window size) used in the liquid crystal display panel 79, for each of various types of processing (the center brightness refers to a brightness around the center of the planar light). An image diagram along the horizontal axis of FIG. 15 means the screen of the liquid crystal display panel 79 (the center brightness Lc, Ld and Le in the figure corresponds to the center brightness Lc, Ld and Le described later).

FIGS. 16A to 16E are brightness distribution diagrams obtained by measuring the brightness along the X direction based on the vicinity of the center of the planar light in the Y direction. The light emission power (W) necessary for the backlight unit 69 to form the brightness distribution shown in these figures is also shown in the figures. The type of lines surrounding the light emission power in the figures corresponds to the type of graph lines indicating the brightness distribution; La to Le in the figures mean the center brightness.

Figure 16A:
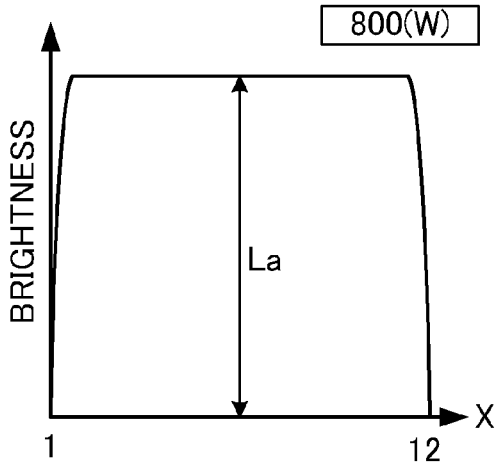
FIG. 16A A brightness distribution diagram that is measured based on the vicinity of the center in the Y direction and along the X direction and that is on the planar light on which the brightness correction processing and the light emission power correction processing have not been performed.

FIG. 16A is a brightness distribution diagram showing a case where the backlight unit 69 emits full-screen planar light of the maximum brightness without performing any processing. As shown in FIG. 16A, the brightness of the illumination regions SA in the perimeter of the entire illumination region SAgr is not significantly different from the brightness (center brightness La) of the illumination regions SA around the center of the entire illumination region SAgr. In order to generate such planar light, the backlight unit 69 consumes a light emission power of 800 W (the allowable light emission power of the backlight unit 69 is assumed to be 400 W). In order to reduce the light emission power of 800 W described above, the brightness correction processing and the light emission power correction processing described above are available.

Figure 16B:
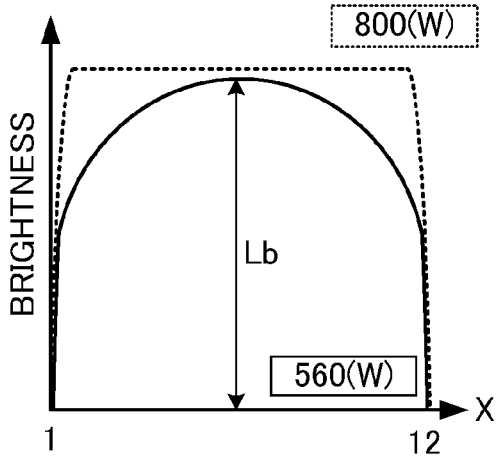
FIG. 16B A brightness distribution diagram that is measured based on the vicinity of the center in the Y direction of the planar light and along the X direction and that is on the planar light on which only the brightness correction processing has been performed.

When the brightness correction processing first reduces the light emission power by 30%, the light emission power of the backlight unit 69 is changed from 800 W to 560 W, and the brightness distribution diagram of the planar light of such light emission power is shown in FIG. 16B. Specifically, the brightness of the illumination regions SA in the perimeter of the entire illumination region SAgr is lower than the brightness (center brightness Lb) of the illumination regions SA around the center of the entire illumination region SAgr, and thus the light emission power of the backlight unit 69 is reduced.

When the brightness of the illumination regions SA in the perimeter is lower than the brightness of the illumination regions SA in the center, the center brightness Lb is slightly lower than the center brightness La in FIG. 16A (La>Lb).

However, as shown in FIG. 16B, even when the brightness correction processing is performed, if the light emission power is 560 W, it exceeds the allowable light emission power of 400 W. Hence, the light emission power correction processing is also performed after the brightness correction processing. Both types of processing (the brightness correction processing→the light emission power correction processing) are performed, and thus when the light emission power of the backlight unit 69 is reduced from 560 W to 400 W (when reduction is performed by about 30%), the brightness distribution diagram of the planar light of such light emission power is shown in FIG. 16C.

Figure 16C:
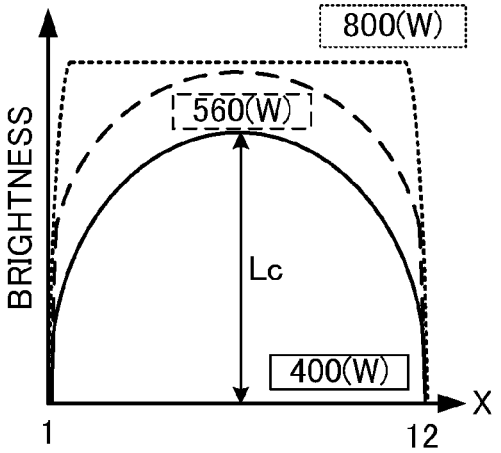
FIG. 16C A brightness distribution diagram that is measured based on the vicinity of the center in the Y direction of the planar light and along the X direction and that is on the planar light on which the light emission power correction processing has been performed after the brightness correction processing.

However, since, in the light emission power correction processing, the PWM values for the entire illumination region SAgr are multiplied by the rate of limitation α (α=400/560), the center brightness Lc in FIG. 16C is lower than the center brightness Lb in FIG. 16B (Lb>Lc).

In the light emission power correction processing after the brightness correction processing described above, under the management of the main micon 12, the LED controller 13 (that is, the micon unit 11) calculates, in the light emission power correction portion 23 (especially, the light emission power calculation circuit 24), the total light emission power of all the LEDs 52 based on the light source color video signals (RSd', GSd' and BSd') on which the brightness correction portion 21 has performed the brightness correction processing (in other words, the light emission power calculation circuit 24 recognizes 560 W).

Then, when the calculated total light emission power exceeds the allowable light emission power (for example, 400 W), the micon unit 11 calculates, in the light emission power correction portion 23 (especially, the light emission power limitation circuit 25), the rate of limitation α that is a scaling factor of the predetermined allowable light emission power for the total light emission power. Then, the light source color video signals (RSd', GSd' and BSd') are multiplied by the rate of limitation α, and thus the light source color video signals (RSd", GSd" and BSd") after the light emission power correction processing are obtained.

When, as described above, the light source color video signals (RSd', GSd' and BSd') after the brightness correction processing are subjected to the light emission power correction processing, "'" is newly added to the signals, and thus the signals are provided with "'". The light source color video signals (RSd", GSd" and BSd") that have received the light emission power correction processing after the brightness correction processing are referred to as light amount adjustment data.

Figure 16D:
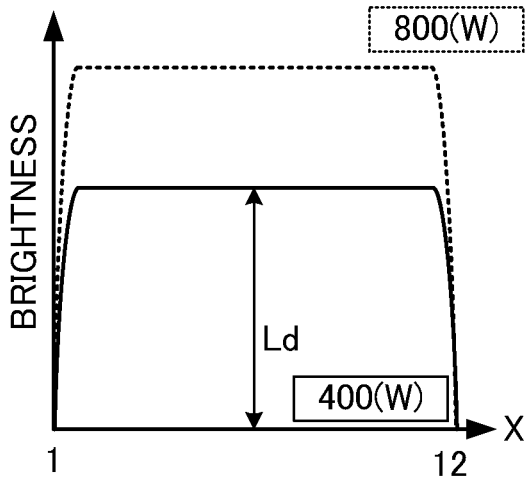
FIG. 16D A brightness distribution diagram that is measured based on the vicinity of the center in the Y direction of the planar light and along the X direction and that is on the planar light on which only the light emission power correction processing has been performed.

On the other hand, when the light emission power correction processing first reduces the light emission power of the backlight unit 69 from 800 W to 400 W (when reduction is performed by 50%), the brightness distribution diagram of the planar light of such light emission power is shown in FIG. 16D. Specifically, since the PWM values of the LEDs 52 corresponding to the entire illumination region SAgr are multiplied by the rate of limitation α (α=400/800), the center brightness Ld in FIG. 16D is significantly lower than the center brightness La in FIG. 16A (La>Ld).

Furthermore, in the light emission power correction processing, unlike the brightness correction processing where the brightness of the illumination regions SA in the perimeter of the entire illumination region SAgr is lower than the brightness of the illumination regions SA around the center, the PWM values of the LEDs 52 corresponding to the entire illumination region SAgr are multiplied by the rate of limitation α. Hence, the center brightness Lb (see FIG. 16D) after the light emission power correction processing is lower than the center brightness Lb (see FIG. 16B) after the brightness correction processing (Lb>Ld).

In the brightness distribution after the brightness correction processing is temporarily performed, as shown in FIG. 16B, the brightness of the illumination regions SA around the center of the entire illumination region SAgr is higher than the brightness of the illumination regions SA in the perimeter (in short, the PWM values of the LEDs 52 corresponding to the illumination regions SA around the center are higher than the PWM values of the LEDs 52 corresponding to the illumination regions SA in the perimeter.

Hence, since the light emission power correction processing after the brightness correction processing is performed, even if the PWM values of the LEDs 52 corresponding to the entire illumination region SAgr are multiplied by the rate of limitation α, the shape of the brightness distribution in FIG. 16C tends to be the same as the shape of the brightness distribution in FIG. 16B (in short, the brightness of the illumination regions SA around the center of the entire illumination region SAgr is higher than the brightness of the illumination regions SA in the perimeter).

Furthermore, since, in the light emission power correction processing after the brightness correction processing, not the light emission power of 800 W but the light emission power of 560 W is reduced to the allowable light emission power of 400 W (see FIGS. 16B and 16C), as compared with only the light emission power correction processing for reducing the light emission power of 800 W to the allowable light emission power of 400 W, the light emission power is not excessively limited (in short, in the light emission power correction processing after the brightness correction processing, the value of the rate of limitation α is high; 400/560>400/800). Hence, the center brightness Ld after the light emission power correction processing (see FIG. 16D) is lower than the center brightness Lc (FIG. 16C) on which the light emission power correction processing has been further performed after the brightness correction processing (Lc>Ld).

Figure 16E:
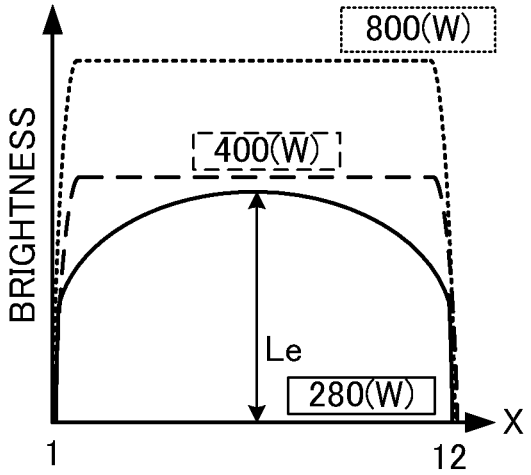
FIG. 16E A brightness distribution diagram that is measured based on the vicinity of the center in the Y direction of the planar light and along the X direction and that is on the planar light on which the brightness correction processing has been performed after the light emission power correction processing.

When, after the light emission power correction processing shown in FIG. 16D, as with the brightness correction processing in FIG. 16B, the brightness correction processing for reducing the light emission power by 30% is performed (the light emission power correction processing→the brightness correction processing), the light emission power of the backlight unit 69 is reduced from 400 W to 280 W. A brightness distribution diagram after both types of processing is shown in FIG. 16E. In the light emission power correction processing, when the brightness of the illumination regions SA in the perimeter is lower than the brightness of the illumination regions SA in the center, the center brightness Le is slightly lower than the center brightness Ld in FIG. 16D (Ld>Le).

When the total light emission power of all the LEDs 52 calculated by the light emission power calculation circuit 24 is less than the allowable light emission power, the light emission power correction portion 23 transmits the light source color video signals (RSd', GSd' and BSd') to the P/S conversion portion 37 without performing the light emission power correction processing (in this case, the light source color video signals (RSd', GSd' and BSd') become the light amount adjustment data).

Hence, the backlight unit 69 is arranged in a plane and emits light according to the light source color video signals (RSd", GSd" and BSd"), and thus the correction processing is performed on a plurality of LEDs 52 forming the planar light and the light source color video signals (RSd, GSd and BSd) based on the basic video signals (FRS, FGS and FBS), with the result that the micon unit 11 for generating the light source color video signals (RSd", GSd" and BSd") is included.

Specifically, the micon unit 11 performs the light emission power correction processing after the brightness correction processing. The micon unit 11 performs, along, for example, the two directions (for example, the X direction and the Y direction) within the plane of the planar light, the brightness correction processing for adjusting the brightness distribution of the planar light on the light source color video signals (RSd, GSd and BSd), and changes them into the light source color video signals (RSd', GSd' and BSd').

Furthermore, the micon unit 11 calculates the total light emission power of all the LEDs 52 based on the light source color video signals (RSd', GSd' and BSd'), and performs, when the total light emission power exceeds the allowable light emission power, the light emission power correction processing for limiting the total light emission power within the allowable light emission power on the light source color video signals (RSd', GSd' and BSd'). Thus, the light source color video signals (RSd", GSd" and BSd") are generated, and the LEDs 52 emit light based on these signals.

Although, in this way, the center brightness (center brightness Lc in FIG. 16C) after both types of processing, that is, the light emission power correction processing after the brightness correction processing, consumes only a light emission power within the allowable light emission power (for example, 400 W), it is relatively high. For example, the center brightness Lc is higher than the center brightness Ld (see FIG. 16D) of only the light emission power correction processing that consumes only the same allowable light emission power.

Figure 17A:
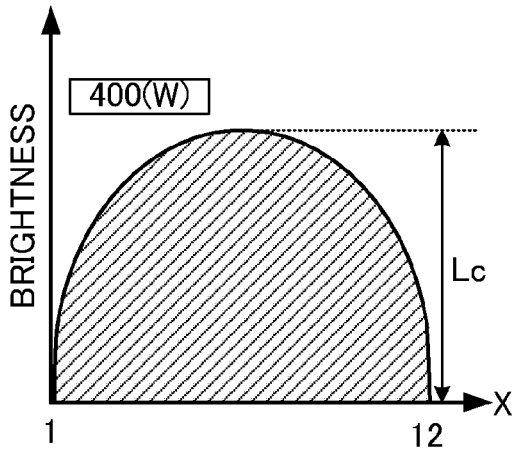
FIG. 17A A brightness distribution diagram that is measured based on the vicinity of the center in the Y direction of the planar light and along the X direction and that is on the planar light on which the light emission power correction processing has been performed after the brightness correction processing.
Figure 17B:
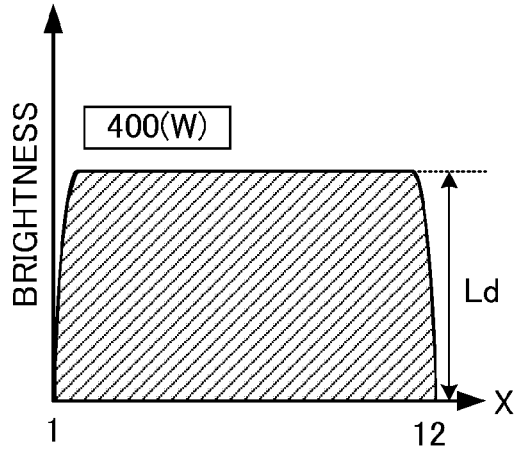
FIG. 17B A brightness distribution diagram that is measured based on the vicinity of the center in the Y direction of the planar light and along the X direction and that is on the planar light on which only the light emission power correction processing has been performed.
Figure 17C:
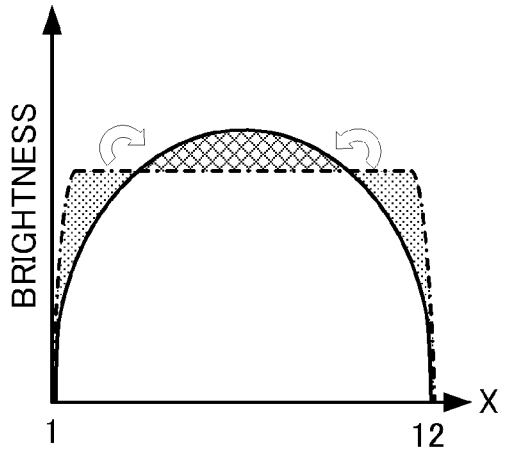
FIG. 17C A brightness distribution diagram that is measured based on the vicinity of the center in the Y direction of the planar light and along the X direction and that is obtained by superimposing the brightness distribution diagram of FIG. 17A on the brightness distribution of FIG. 17B.

The function (the effect of the action) of the backlight unit 69 discussed above will be specifically described below with reference to FIGS. 17A to 17C. FIG. 17A is brightness distribution obtained when the light emission power of 400 W in FIG. 16C is used; FIG. 17B is brightness distribution obtained when the light emission power of 400 W in FIG. 16D is used; FIG. 17C is brightness distribution obtained when the brightness distribution of FIG. 17A is superimposed on the brightness distribution of FIG. 17B. When the light emission power is shown to correspond to the area surrounded by the graph lines of the brightness distribution, the area of a diagonally shaded portion in FIG. 17A is equal to that of a diagonally shaded area in FIG. 17B.

As shown in FIG. 17A, the backlight unit 69 performing the light emission power correction processing after the brightness correction processing uses the limited allowable light emission power (for example, 400 W). The light emission power can be limited to the allowable light emission power by performing only the light emission power correction processing as shown in FIG. 17B. However, as shown in FIG. 17C, the backlight unit 69 performing the light emission power correction processing after the brightness correction processing uses a light emission power indicated by a portion of net-shaped points as a light emission power indicated by a portion of net-shaped lines (see white arrows). Specifically, the backlight unit 69 changes, within the allowable light emission power, the distribution of the light emission power necessary for generating the planar light, and thereby can change the brightness distribution variously.

Consequently, the backlight unit 69 uses a light emission power within the allowable light emission power to supply the planar light (for example, planar light having the brightness around the center increased) having various types of brightness distribution, and also can reduce the light emission power (in other words, the backlight unit 69 can obtain both effects of actions, that is, the effect of the action of the brightness correction processing alone and the effect of the action of the light emission power correction processing alone). In particular, since the brightness around the center of the planar light peaks (becomes peak brightness), the backlight unit 69 consumes a low light emission power and also significantly facilitates the enhancement of the image quality of the liquid crystal display device 89 (the center brightness Lb to Le in FIGS. 16B to 16E can also be said to be the peak brightness Lb to Le).

Part or all of the reception portion 41, the video signal processing portion 42, the liquid crystal display panel controller 43 and the micon unit 11 (the main micon 12 and the LED controller) shown in FIG. 1 may be incorporated in the liquid crystal display panel 79 or may be incorporated in the backlight unit 69. In short, these members are preferably incorporated in the liquid crystal display device 89. However, when the brightness correction processing and the light emission power correction processing described above are performed by the backlight unit 69 alone, at least the reception portion 41, the video signal processing portion 42 and the micon unit 11 are incorporated in the backlight unit 69.

As shown in FIG. 13, the shape of the graph lines of the filter FT (X, Y) is preferably symmetric with respect to the center in each of the directions (the X direction and the Y direction) (in other words, the filter values in each of the directions preferably have a symmetric relationship). This is because the capacity of the filter memory 22 for storing the filter FT is reduced.

Although the brightness correction processing described above is performed according to the X direction and the Y direction in the LEDs 52 in a planar arrangement, the present invention is not limited to this configuration. For example, the micon unit 11 (specifically, the brightness correction portion 21) can also perform the brightness correction processing according to the X direction alone or according to the Y direction alone.

Although, in the above description, the brightness correction processing in the X direction is first performed, and then the brightness correction processing in the Y direction is performed, the present invention is not limited to this order; they may be performed in the reverse order. The brightness correction processing may be performed along another direction other than the X direction and the Y direction or a plurality of directions, that is, two directions or more.

By contrast, the correction processing may be performed in only one direction, for example, in the X direction alone or in the Y direction alone. This is because, when the light emission power correction processing is performed after the brightness correction processing, even if the brightness correction processing is performed in only one direction, the backlight unit 69 changes, within the allowable light emission power, the distribution of the light emission power necessary for generating the planar light, and thereby can change the brightness distribution variously.

Second Embodiment

A second embodiment will be described. Members having the same functions as the members used in the first embodiment are identified with like symbols, and their description will not be repeated. The present embodiment will be described in that there is a case where the brightness correction processing is not performed, and a description will also be given of which parameter is used to perform selection as to which one of a plurality of filters FT (X, Y) is selected, when the brightness correction processing is performed.

As described in the first embodiment, there are a plurality of filters FT (X, Y), for example, the filter FT1 (X, Y) (brightness correction (high) type), the filter FT2 (X, Y) (brightness correction (medium) type) and the filter FT3 (X, Y) (brightness correction (low) type). However, the brightness correction processing is not necessarily performed by the brightness correction portion 21 (hence, the micon unit 11). For example, on the liquid crystal display panel 79, the basic video signals that are the image data are displayed as an image; depending on the display format (display mode) of the image, the brightness correction processing may be unnecessary.

For example, when the liquid crystal display device 89 connected to a personal computer displays image data of the personal computer on the liquid crystal display panel 79, the uniformity of the display image (uniformity of brightness) is required to be relatively high. For example, when the liquid crystal display device 89 serving as a liquid crystal television set displays a still image on the liquid crystal display panel 79, the uniformity of the display image is required to be relatively high.

Hence, in these display modes described above, that is, in a PC image display mode where the image of a personal computer (PC) is displayed and in a still image display mode where a still image is displayed, the liquid crystal display device 89 (in other words, the backlight unit 69) does not perform the brightness correction processing. Then, since the brightness correction processing is not performed, for example, as shown in FIG. 3, the entire illumination region SAgr (planar light) is formed by all the LEDs 52 according to the PWM value of "4095". Hence, the uniformity of the image displayed on the liquid crystal display panel 79 is reliably enhanced by reception of the planar light.

As the display mode in which the basic video signals (specifically, which can also be said to be the process color video signals (RSp, GSp and BSp) transmitted to the liquid crystal display panel controller 43) that are image data, various other display modes are present. A member that manages which display mode is set is the micon unit 11.

Specifically, the main micon 12 transmits the set display mode to the brightness correction portion 21 of the LED controller 13. Then, the brightness correction portion 21 selects the filter FT (X, Y) corresponding to the set display mode, and uses the filter FT (X, Y) to perform the brightness correction processing (naturally, as described above, the brightness correction portion 21 can selectively perform no brightness correction processing).

For example, when the liquid crystal display device 89 serving as a liquid crystal television set can set a dynamic display mode in which an image having a high brightness is displayed, the brightness correction portion 21 selects the filter FT3 (X, Y) (brightness correction (low) type) corresponding to the dynamic display mode, and performs the brightness correction processing.

In this way, as shown in FIG. 12, the brightness of the illumination regions SA in the perimeter of the entire illumination region SAgr is slightly lower than the brightness of the illumination regions SA around the center, but a relatively high brightness is maintained as the brightness of the entire illumination region SAgr. Hence, the liquid crystal display device 89 including the backlight unit 69 that generates the planar light formed with the entire illumination region SAgr described above provides an image corresponding to a display mode desired by the viewer and can also reduce the light emission power.

When the liquid crystal display device 89 serving as a liquid crystal television set can set a standard display mode where an image having a standard brightness is displayed, the brightness correction portion 21 selects the filter FT1 (X, Y) (brightness correction (high) type) corresponding to the standard display mode, and performs the brightness correction processing.

In this way, as shown in FIG. 6, the brightness of the illumination regions SA in the perimeter of the entire illumination region SAgr is significantly lower than the brightness of the illumination regions SA around the center (the brightness gradient is steep). However, in the standard display mode, an excessively high brightness is not required, and the illumination regions SA around the center of the entire illumination region SAgr have a relatively high brightness. Hence, the viewer does not determine that variations in brightness are included in the planar light corresponding to the standard display mode.

Consequently, the liquid crystal display device 89 described above provides an image corresponding to a display mode desired by the viewer, and also can reduce a large amount of light emission power (when the filter FT1 (X, Y) is used, as compared with the case where another filter, that is, the filter FT2 (X, Y) or the filter FT3 (X, Y), is used, the light emission power is most reduced).

Hence, the micon unit 11 included in the backlight unit 69 (therefore, the liquid crystal display device 89) changes the brightness correction processing according to the display mode of the image data (for example, the PC display mode, the still image display mode, the dynamic display mode and the standard display mode). Thus, not only a brightness suitable for the display mode is acquired but also the consumption of the light emission power is reduced according to the display mode (when the LED 52 includes the LED chips 53R, 53G and 53G, variations in colors are also removed).

Third Embodiment

A third embodiment will be described. Members having the same functions as the members used in the first and second embodiments are identified with like symbols, and their description will not be repeated. In the present embodiment, a description will be given of which one of a plurality of filters FT (X, Y) is selected using a parameter other than the display mode.

As one of the functions included in the main micon 12 in the micon unit 11, there is a function of detecting the average brightness level (APL; average picture level). The APL detection function is to determine the average value (APL value) of gradations of an image displayed on the liquid crystal display panel 79. For example, as shown in FIG. 1, the main micon 12 receives the panel process red video signals (RSp, GSp and BSp) and synchronization signals related to these signals, thereby specifies an image displayed in one frame term and calculates the APL value of the gradation of the image.

For example, when a white image is displayed on the liquid crystal display panel 79, the APL value (brightness level) becomes 100% whereas, when a black image is displayed on the liquid crystal display panel 79, the APL value becomes 0%. Hence, the micon unit 11 may perform the brightness correction processing according to the APL value.

For example, when the APL value is equal to or more than 75% but equal to or less than 100%, and an image or the like having a color close to white of high brightness is displayed on the liquid crystal display panel 79, the micon unit 11 (specifically, the brightness correction portion 21) preferably performs the brightness correction processing using the filter FT1 (X, Y) (brightness correction (high) type).

In the brightness correction processing described above, since, as shown in FIG. 6, the illumination regions SA around the center of the entire illumination region SAgr have a relatively high brightness, the viewer does not determine that the entire illumination region SAgr includes variations in brightness. On the other hand, since the brightness of the illumination regions SA in the perimeter of the entire illumination region SAgr is significantly lower than the brightness of the illumination regions SA around the center, a large amount of light emission power is reduced. In other words, when the brightness correction processing described above is performed in the liquid crystal display device 89, it is possible to display an image according to the height of the APL value and to reduce the light emission power.

By contrast, when the APL value is equal to or more than 0% but less than 25%, and an image or the like close to black of low brightness is displayed on the liquid crystal display panel 79, the micon unit 11 does not perform the brightness correction processing using the filter FT (X, Y). This is because, when the image close to black is displayed on the liquid crystal display panel 79, since not all the LEDs 52 in the backlight unit 69 need to emit light of high brightness, the necessity of prevention of variations in brightness and the necessity of the decrease in the light emission power are reduced.

This can also be described as follows. For example, when, as the image close to black of low brightness, an image of a night sky where a plurality of stars shine with the same brightness is displayed on the liquid crystal display panel 79, if the brightness correction processing is performed, a difference in brightness between the stars is produced, and it matches with the image of the night sky and becomes noticeable (in short, the viewer feels poor image quality).

However, if the brightness correction processing is not performed, since all the stars shine with the same brightness, the viewer can recognize the image of the beautiful night sky. In other words, when the APL value is equal to or more than 0% but less than 25%, and the image or the like close to black of low brightness is display on the liquid crystal display panel 79, the micon unit 11 can also be said to give priority to the image quality on the liquid crystal display panel 79.

At any APL value between the APL value equal to or more than 0% but less than 25% and the APL value equal to or more than 75% but equal to or less than 100%, that is, at an APL value equal to or more than 25% but less than 75%, the micon unit 11 preferably performs the brightness correction processing using the filter FT3 (X, Y) (brightness correction (low) type) and the filter FT2 (X, Y) (brightness correction (medium) type) that have a lower brightness correction level than the filter FT1 (X, Y).

For example, when the APL value is equal to or more than 25% but less than 50%, and an image or the like slightly brighter than black is displayed on the liquid crystal display panel 79, the micon unit 11 preferably uses the filter FT3 (X, Y) (brightness correction (low) type) to perform the brightness correction processing; when the APL value is equal to or more than 50% but less than 75%, and an image or the like slightly darker than white is displayed on the liquid crystal display panel 79, the micon unit 11 preferably uses the filter FT2 (X, Y) (brightness correction (medium) type) to perform the brightness correction processing.

Hence, the micon unit 11 included in the backlight unit 69 (therefore, the liquid crystal display device 89) changes the brightness correction processing according to the APL value. Thus, the planar light has a brightness suitable for the APL value, and furthermore, the light emission power is reduced according to the APL value (when the LED 52 includes the LED chips 53R, 53G and 53B, variations in colors are also removed).

Incidentally, since the frame image changes with time, the APL value also changes with time. Hence, the APL value can suddenly change from 100% to 15%. In this case, when the APL value is 100%, the brightness correction processing using the filter FT1 (X, Y) (brightness correction (high) type) is performed whereas, when the APL value is 15%, the brightness correction processing is not performed. However, when the brightness correction processing using the filter FT1 (X, Y) which is being performed is suddenly stopped, variations in brightness can be visually identified as flicker.

Hence, in order to prevent the flicker, when the degree (level) of the brightness correction processing is set stepwise, the brightness correction processing is performed in the set stepwise order. A description will be given with respect to FIG. 18 in which, for example, in the horizontal axis, the filters FT1 (X, Y) to FT3 (X, Y) and no brightness correction processing (filter off) are made to correspond to the APL value, and which shows, in the vertical axis, the degree (level) of the brightness correction processing of the filters FT1 (X, Y) to FT3 (X, Y).

Figure 18:
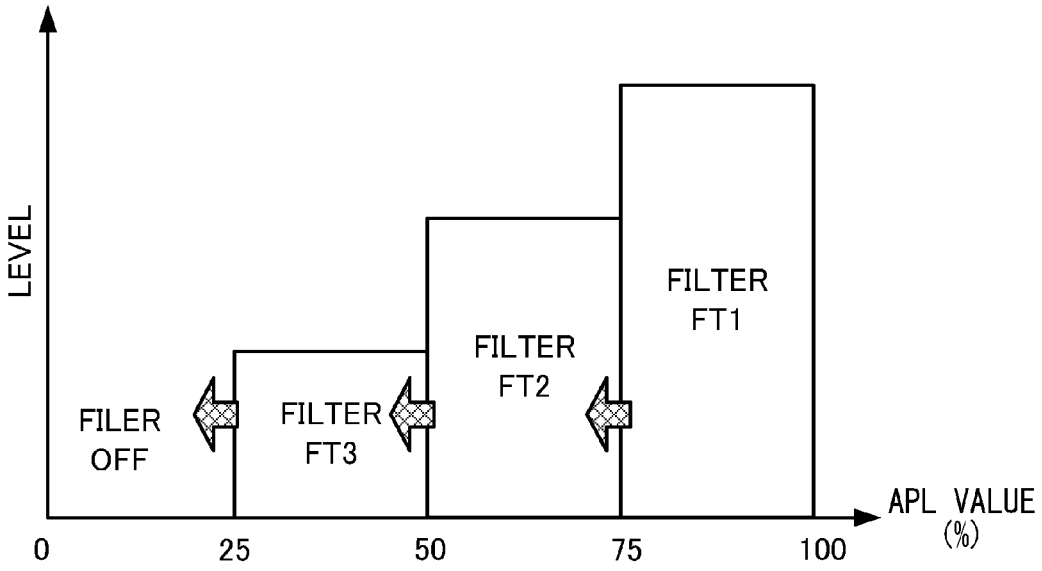
FIG. 18 An illustration diagram in which, in the horizontal axis, the filters FT1 (X, Y) to FT3 (X, Y) and no brightness correction processing (filter off) are made to correspond to an APL value, and which shows, in the vertical axis, the degree (level) of the brightness correction processing of the filters FT1 (X, Y) to FT3 (X, Y)

First, when the APL value changes from 100% to 15%, the micon unit 11 suddenly does not stop the brightness correction processing using the filter FT1 (X, Y) (brightness correction (high) type) (the vertical axis of FIG. 18 also shows the degree of the reduction of the light emission power). Specifically, the micon unit 11 performs the brightness correction processing using the filter FT1 (X, Y), thereafter performs the brightness correction processing using the filter FT2 (X, Y) (brightness correction (medium) type) and further performs the brightness correction processing using the filter FT3 (X, Y) (brightness correction (low) type), and then the brightness correction processing is stopped (see arrows of net-shaped lines in FIG. 18).

In other words, when the APL value changes from a certain value (for example, 100%) to another value (for example, 15%), if an intermediate brightness correction processing level is present between the brightness correction processing level corresponding to the certain value of the APL value and the brightness correction processing level corresponding to the another value of the APL value, the micon unit 11 stepwise changes the levels to perform the brightness correction processing through the intermediate brightness correction processing level (naturally, the stepwise change of the brightness correction processing in the opposite direction to the arrows of FIG. 18 can be considered).

Hence, even when the brightness correction processing is performed according to the rapid change of the APL value, variations in brightness resulting from the brightness correction processing are not produced. Thus, the liquid crystal display device 89 incorporating the backlight unit 69 having the brightness correction processing function described above can provide a high-quality image.

Fourth Embodiment

A fourth embodiment will be described. Members having the same functions as the members used in the first to third embodiments are identified with like symbols, and their description will not be repeated. In the present embodiment, a description will be given of which one of a plurality of filters FT (X, Y) is selected using a parameter other than the display mode and the APL value.

In general, the LED 52 has the property of reducing the brightness due to the effects of the light emission heat of itself and the raised temperature of outside air by the light emission heat. When the LEDs 52 are arranged, in a matrix, in the backlight unit 69 of the liquid crystal display device 89, in particular, the LEDs 52 around the center are more likely to be decreased in brightness due to the effects of the temperature.

This is because, due to the structure of the backlight unit 69, heated air is unlikely to be escaped to the outside from the surrounding of the LEDs 52 around the center of the matrix, and, in the surroundings, various electronic components are arranged, and high-temperature air heated by the heat of drive of the electronic components further causes the temperature of the LEDs 52 to be increased.

Hence, the thermistors 55 for measuring the temperature of the LEDs 52 are attached to the backlight unit 69, and the temperature correction portion 35 of the LED controller 13 uses the measured temperature of the thermistors 55 to correct variations in the brightness of the LEDs 52 resulting from the temperature. Specifically, the temperature correction portion 35 reduces the light emission brightness of the LEDs 52 according to the temperature of the LEDs 52 (by temperature feedback), and thereby reduces variations in the brightness of the planar light and variations in the colors of the planar light. The micon unit 11 may perform the brightness correction processing according to the temperature of the LEDs 52.

For example, when the temperature of the LEDs 52 is increased to a temperature equal to or more than 55° C. but equal to or less than about 70° C., the micon unit 11 (specifically, the brightness correction portion 21) preferably performs the brightness correction processing using the filter FT1 (X, Y) (brightness correction (high) type).

In the brightness correction processing described above, as the brightness of the LEDs 52 around the center of the matrix, that is, the brightness of the illumination regions SA around the center of the entire illumination region SAgr, is reduced by temperature feedback, the brightness of the illumination regions SA in the perimeter of the entire illumination region SAgr is reduced (see FIG. 6).

In other words, even if the brightness of the illumination regions SA around the center of the entire illumination region SAgr is reduced by temperature feedback, the brightness of the entire illumination region SAgr is reduced by the brightness correction processing, with the result that the planar light includes no variations in brightness. Moreover, the brightness of the illumination regions SA in the perimeter of the entire illumination region SAgr is reduced, and thus the light emission power is reduced.

By contrast, when the temperature of the LEDs 52 is equal to or more than 0° C. but less than 40° C., the micon unit 11 performs the brightness correction processing using not the filter FT1 (X, Y) but the filter FT3 (X, Y) (brightness correction (low) type).

In general, when the temperature of the LEDs 52 is equal to or more than 0° C. but less than 40° C., the LEDs 52 around the center of the matrix are not heated excessively, and thus the brightness of the LEDs 52 is only slightly reduced. Hence, when the brightness correction processing using the filter FT1 (X, Y) is performed, though the brightness of the illumination regions SA around the center of the entire illumination region SAgr is only slightly reduced, the brightness of the illumination regions SA in the perimeter of the entire illumination region SAgr is reduced. In other words, the planar light includes variations in brightness.

Hence, the micon unit 11 performs the brightness correction processing using the filter FT3 (X, Y) (brightness correction (low) type) for preventing the brightness of the illumination regions SA in the perimeter of the entire illumination region SAgr from being excessively reduced. In this way, the brightness of the entire illumination region SAgr is not excessively reduced, and the brightness of the illumination regions SA in the perimeter is reduced, and thus the light emission power is reduced (see FIG. 12).

At any temperature of the LEDs 52 between the temperature equal to or more than 0° C. but less than 40° C. and the temperature equal to or more than 55° C. but less than about 70° C., that is, at a temperature equal to or more than 40° C. but less than 55° C., the micon unit 11 preferably performs the brightness correction processing using the filter FT2 (X, Y) (brightness correction (medium) type) having an intermediate brightness correction processing level between the filter FT1 (X, Y) and the filter FT3 (X, Y).

Hence, the micon unit 11 included in the backlight unit 69 (therefore, the liquid crystal display device 89) changes the brightness correction processing according to the temperature of the LEDs 52. Hence, a brightness suitable for the effect of the temperature of the LEDs 52 is acquired, and furthermore, the light emission power is reduced according to the effect of the temperature of the LEDs 52 (when the LED 52 includes the LED chips 53R, 53G and 53B, variations in colors are also removed).

In the above description, the LED controller 13 acquires, through the temperature correction portion 35, data on the measured temperature (temperature of the LEDs 52) of the thermistors 55. Hence, the brightness correction processing depending on the temperature of the LEDs 52 may be performed by the brightness correction portion 21 under the management of the LED controller 13 itself (naturally, the brightness correction portion 21 may perform the brightness correction processing depending on the temperature of the LEDs 52 under the management of the main micon 12).

Incidentally, the temperature of the LEDs 52 changes according to the conditions of the drive of the LEDs 52. For example, when the LED 52 is used that emits light for a given period of time based on a constant current, the temperature of the LED 52 is gradually increased as time passes (for example, the temperature of the LED 52 changes from about 25° C., which is called the room temperature, to about 70° C.).

Hence, when the degree (level) of the brightness correction processing is set stepwise, the brightness correction processing is performed in the set stepwise order. A description will be given with respect to FIG. 19 in which, for example, in the horizontal axis, the filters FT1 (X, Y) to FT3 (X, Y) are made to correspond to the temperature of the LEDs 52, and which shows, in the vertical axis, the degree (level) of the brightness correction processing of the filters FT1 (X, Y) to FT3 (X, Y).

Figure 19:
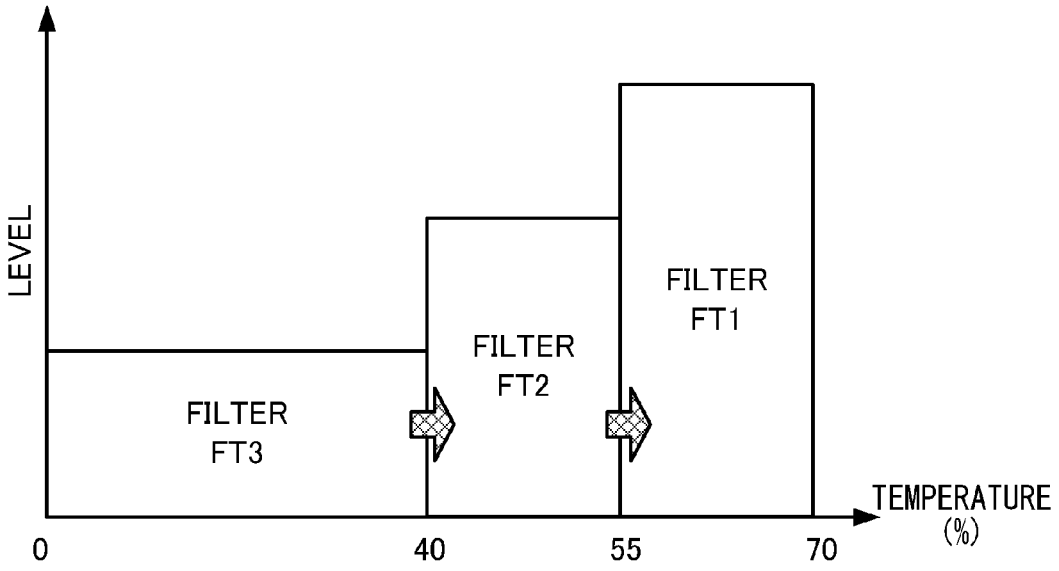
FIG. 19 An illustration diagram in which, in the horizontal axis, the filters FT1 (X, Y) to FT3 (X, Y) are made to correspond to the temperature of the LEDs, and which shows, in the vertical axis, the degree (level) of the brightness correction processing of the filters FT1 (X, Y) to FT3 (X, Y)

In FIG. 19, in the process in which the temperature changes from about 25° C. to about 70° C., the micon unit 11 performs the brightness correction processing using the filter FT3 (X, Y) (brightness correction (low) type), further performs the correction processing using the filter FT2 (X, Y) (brightness correction (medium) type) and thereafter performs the brightness correction processing using the filter FT1 (X, Y) (brightness correction (high) type) (see arrows of net-shaped lines in FIG. 19).

In other words, when the temperature of the LEDs 52 changes from a certain temperature (for example, about 25° C.) to another temperature (for example, about 70° C.), if an intermediate brightness correction processing level is present between the brightness correction processing level corresponding to the certain temperature and the brightness correction processing level corresponding to the another temperature, the micon unit 11 stepwise changes the levels to perform the brightness correction processing through the intermediate brightness correction processing level (naturally, the stepwise change of the brightness correction processing in the opposite direction to the arrows of FIG. 19 can be considered).

Hence, even when the brightness correction processing is performed according to the temperature change of the LEDs 52, variations in brightness resulting from the brightness correction processing are not produced. Thus, the liquid crystal display device 89 incorporating the backlight unit 69 having the brightness correction processing function described above can provide a high-quality image.

Fifth Embodiment

A fifth embodiment will be described. Members having the same functions as the members used in the first to fourth embodiments are identified with like symbols, and their description will not be repeated. In the present embodiment, a description will be given of which one of a plurality of filters FT (X, Y) is selected using a parameter other than the display mode, the APL value and the temperature of the LEDs 52.

When, filters, like the filters FT1 (X, Y) to FT3 (X, Y), that increase the brightness around the center of the planar light as compared with the brightness in the perimeter of the planar light are used for the brightness correction processing, as shown in, for example, FIGS. 6, 9, 12 and 17, the vicinity of the center of the planar light has a peak brightness. The reason why the vicinity of the center of the planar light, that is, the vicinity of the center of the liquid crystal display panel 79 receiving the planar light, is made to have the peak brightness is that the user is assumed to be in front of the vicinity of the center of the liquid crystal display panel 79. However, the user is not always in front of the vicinity of the center of the liquid crystal display panel 79.

Figure 20A:
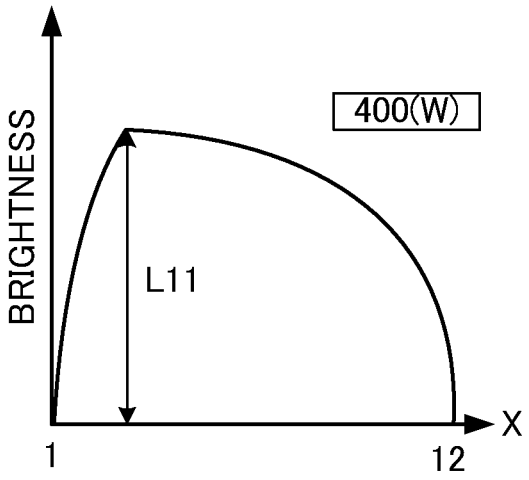
FIG. 20A A brightness distribution diagram that is measured based on the vicinity of the center in the Y direction of the planar light and along the X direction and that is on the planar light on which the light emission power correction processing has been performed after the brightness correction processing.

Hence, the filter memories 22 (X) and 22(Y) of the backlight unit 69 store a filter FT other than the filters FT1 (X, Y) to FT3 (X, Y), for example, a filter FT11 (X, Y) for generating the planar light shown in FIG. 20A (FIG. 20A is drawn in the same manner as FIG. 17A).

The filter FT11 (X, Y) generates planar light in which the position of the peak brightness L11 of the planar light is slightly displaced from the center. Specifically, the backlight unit 69 assumes that the user is in front of the illumination region SA where the planar light has the peak brightness L11, and uses the filter FT11 (X, Y) for the brightness correction processing.

The reason why the backlight unit 69 can determine the position of the user is that, as shown in FIG. 1, the micon unit 11 (specifically, the brightness correction portion 21)

acquires detection data of the detection sensor 57 attached to the backlight unit 69. The detection sensor 57 is, for example, an infrared sensor, a camera sensor or an ultrasonic sensor that is known, and detects the position of the user in front of the liquid crystal display panel 79 of the backlight unit 69 (hence, the liquid crystal display device 89).

Then, the brightness correction portion 21 selects, from the data on the position of the user from the detection sensor 57, the filter FT11 (X, Y) that can generate planar light in which the position of the user has the peak brightness (in short, the brightness correction portion 21 selects the filter FT11 (X, Y) such that the user can view a screen corresponding to the illumination region SA having the peak brightness L11).

Figure 20B:
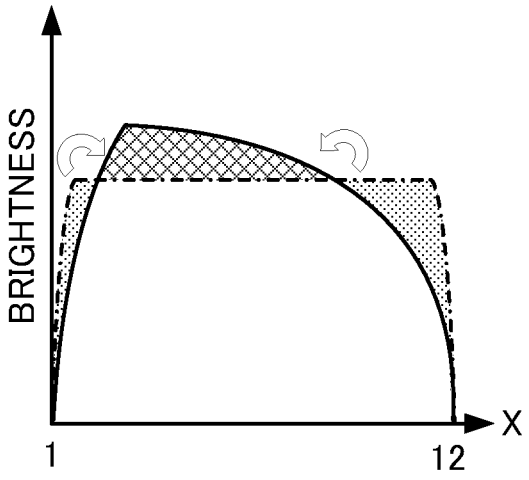
FIG. 20B A brightness distribution diagram that is measured based on the vicinity of the center in the Y direction of the planar light and along the X direction and that is obtained by superimposing the brightness distribution diagram of FIG. 20A on the brightness distribution of the planar light on which only the light emission power correction processing has been performed.

Then, when the light emission power correction processing is performed after the brightness correction processing using the filter FT11 (X, Y), the brightness distribution of the planar light is brightness distribution shown in FIG. 20A. When the brightness distribution of the planar light shown in FIG. 20A is compared with the brightness distribution of the planar light on which only the light emission power correction processing has been performed such that the light emission power is within the allowable light emission power, it is found that, as shown in FIG. 20B (which is drawn in the same manner as FIG. 17C), a light emission power indicated by a portion of net-shaped points is used as a light emission power indicated by a portion of net-shaped lines (see white arrows).

Specifically, the backlight unit 69 checks the position of the user with the detection sensor 57 to select the optimum filter FT, and thereby changes, within the set light emission power, the distribution of the light emission power necessary for generating the planar light, and thereby can change the planar light into the brightness distribution that is easily viewed by the user.

In front of the liquid crystal display panel 79, instead of one user, a plurality of users may be present. Hence, when the detection sensor 57 detects that the number of users is, for example, two, the brightness correction portion 21 selects a filter FT12 (X, Y) that can generate planar light in which the position of the user has the peak brightness L12, from data on the position of the two users from the detection sensor 57.

Figure 21A:
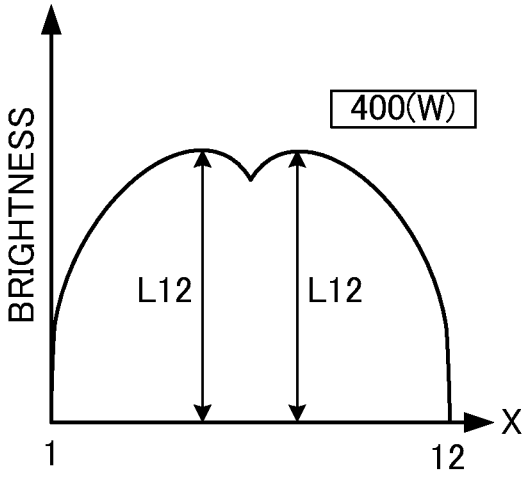
FIG. 21A A brightness distribution diagram that is measured based on the vicinity of the center in the Y direction of the planar light and along the X direction and that is on the planar light on which the light emission power correction processing has been performed after the brightness correction processing.
Figure 21B:
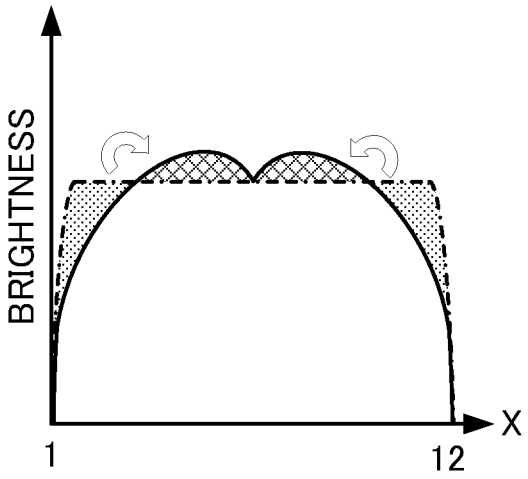
FIG. 21B A brightness distribution diagram that is measured based on the vicinity of the center in the Y direction of the planar light and along the X direction and that is obtained by superimposing the brightness distribution diagram of FIG. 21A on the brightness distribution of the planar light on which only the light emission power correction processing has been performed.

Then, when the light emission power correction processing is performed after the brightness correction processing using the filter FT12 (X, Y), the brightness distribution of the planar light is brightness distribution shown in FIG. 21A. When the brightness distribution of the planar light shown in FIG. 21A is compared with the brightness distribution of the planar light on which only the light emission power correction processing has been performed such that the light emission power is within the allowable light emission power, it is found that, as shown in FIG. 22B (which is drawn in the same manner as FIG. 17C), a light emission power indicated by a portion of net-shaped points is used as a light emission power indicated by a portion of net-shaped lines (see white arrows).

Specifically, the backlight unit 69 checks the position of the user with the detection sensor 57 to select the optimum filter FT (for example, the filter FT11 (X, Y) or the filter FT12 (X, Y)), and thereby changes, within the allowable light emission power, the distribution of the light emission power necessary for generating the planar light, and thereby can change the planar light into the brightness distribution that is easily viewed by the user.

Other Embodiments

The present invention is not limited to the embodiments described above; various modifications are possible without departing from the spirit of the present invention.

For example, in the above embodiment, although, due to the figures, the PWM value shown in the figures is obtained by illustrating one LED chip 53, for convenience, the PWM value corresponding to the remaining LED chips 53 is the same as the value shown in the figures. However, the LED chips 53R, 53G and 53B may naturally differ in the PWM value from each other.

The PWM values of the LEDs 52 corresponding to the individual illumination regions SA may be determined based on the maximum value of the panel process color video signals (RSp, GSp and BSp) corresponding to the individual illumination regions SA (hence, the maximum value of the basic video signals (FRS, FGS and FBS). In general, a plurality of pixels are present within the liquid crystal display panel 79 corresponding to the individual illumination regions SA. Hence, among a plurality of panel process color video signals (RSp, GSp and BSp), based on the maximum value thereof, the PWM value of the illumination regions SA may be determined.

In this way, the light source color video signals (RSd, GSd and BSd) are increased according to the maximum value of the panel process color video signals (RSp, GSp and BSp). Then, under the condition in which the total light emission power of all the LEDs 52 is more likely to exceed the allowable light emission power, the light emission power correction processing is performed. Hence, the light emission power of the backlight unit 69 can be reliably reduced.

However, the method of determining the PWM value of the LEDs 52 corresponding to the individual illumination regions SA is not limited to this method; for example, the PWM value may be determined based on the average value of a plurality of panel process color video signals (RSp, GSp and BSp) corresponding to the individual illumination regions SA.

The determination of the PWM value based on each of the panel process color video signals (RSp, GSp and BSp) is assumed to be performed every period of the frame of an image. The period for determining the PWM value is not limited to the period of the frame. For example, as the period for determining the PWM value, the PMW value may be determined every 5 frames or every 30 frames. When the display image is a still image, the PWM value may be determined only when the screen is changed.

When the light emission power correction processing is performed to limit the light emission power of the LEDs 52 corresponding to the individual illumination regions SA such that the total light emission power of all the LEDs 52 is within the allowable light emission power, the light emission power is multiplied by the same rate of limitation $\alpha$ (see formula 5). However, the present invention is not limited to this configuration. For example, the rate of limitation $\alpha$ for the illumination regions SA may differ.

Furthermore, when the light emission power of the LEDs 52 corresponding to the individual illumination regions SA is limited, the limitation is not necessarily performed using the rate of limitation $\alpha$. In short, the light emission power for the individual illumination regions SA is preferably limited such that the total light emission power of all the LEDs 52 is within the allowable light emission power. For example, a different light emission power correction may be performed on the LED 52 corresponding to the individual illumination regions SA based on the panel process color video signals (RSp, GSp and BSp) corresponding to the individual illumination regions SA.

Although, in the above description, an example where the allowable light emission power of the light emission power of the backlight unit 69 is constant has been shown, the present invention is not limited to this example; the allowable light emission power may vary. For example, the allowable light emission power may be the worst value among the R light emission power amount, the G light emission power amount and the B light emission power amount (see formulas 1 to 3). Specifically, when the rate of limitation α is determined, the following formulas 5-1 to 5-3 are used to determine the rate of limitation (Rα, Gα or Bα) for the individual colors.

rate of limitation $R\alpha$=allowable light emission power necessary for red light emission/$R$ light emission power amount (formula 5-1)

rate of limitation $G\alpha$=allowable light emission power necessary for green light emission/$G$ light emission power amount (formula 5-2)

rate of limitation $B\alpha$=allowable light emission power necessary for blue light emission/$R$ light emission power amount (formula 5-3)

Then, as the rate of limitation α (see formula 6) by which the whole is multiplied, the lowest value (worst value) among Rα, Gα and Bα is selected. In this case, it may be assumed that allowable light emission power necessary for red light emission=allowable light emission power necessary for green light emission=allowable light emission power necessary for blue light emission or it may be assumed that the allowable light emission power is changed for each color (R/G/B) and is set, and that the lowest value (worst value) among Rα, Gα and Bα is finally selected.

As described above, as the rate of limitation α by which the whole is multiplied, the lowest value (worst value) among Rα, Gα and Bα is selected, and thus, even if the light emission power amount for each color differs, it is possible to reliably limit the light emission power to the allowable light emission power or less for each color, and the limited total light emission power is limited to the allowable light emission power or less. When the supply of the light emission power to the backlight unit 69 is performed by a plurality of power supplies, the allowable light emission power may differ for each of the power supplies, and the light emission power may be corrected for each of the power supplies.

A light emission power calculation step (a processing step performed by the light emission power calculation circuit 24) and a light emission power limitation process (a processing step performed by the light emission power limitation circuit 25) in the light emission power correction processing are performed in the final stage among a plurality of types of processing by the LED controller 13. Hence, even when various types of processing (for example, white balance adjustment and temperature correction processing) other than the light emission power correction processing are performed, as compared with the case where the light emission power correction processing is performed before those types of processing, it is possible to reduce the effects of various types of processing on the light emission power correction processing.

In other words, the light emission power correction processing is performed in the final stage of various types of processing, and thus, even if the PWM value is corrected by processing before the light emission power correction processing, the light emission power correction processing is performed based on the corrected PWM value.

Incidentally, as shown in FIG. 1, for each of the LED chips 53R, 53G and 53B, the filter FT (X, Y) differs (FT R-(X), FT G-(X), FT B-(X), FT R-(Y), FT G-(Y) and FT B-(Y)). Hence, the micon unit 11 performs different brightness correction processing for each of the colors, and thus it is possible to reduce not only the brightness correction processing but also variations in colors.

Moreover, for each of the parameters (such as the display mode, the APL value, the temperature of the LEDs 52 and the position of the user), the filter FT (X, Y) preferably differs; furthermore, the filter FT (X, Y) differing for each of the parameters may differ for each of the LED chips 53R, 53G and 53B. In this way, it is possible to perform the brightness correction and the color variation correction of higher quality.

Figure 22:
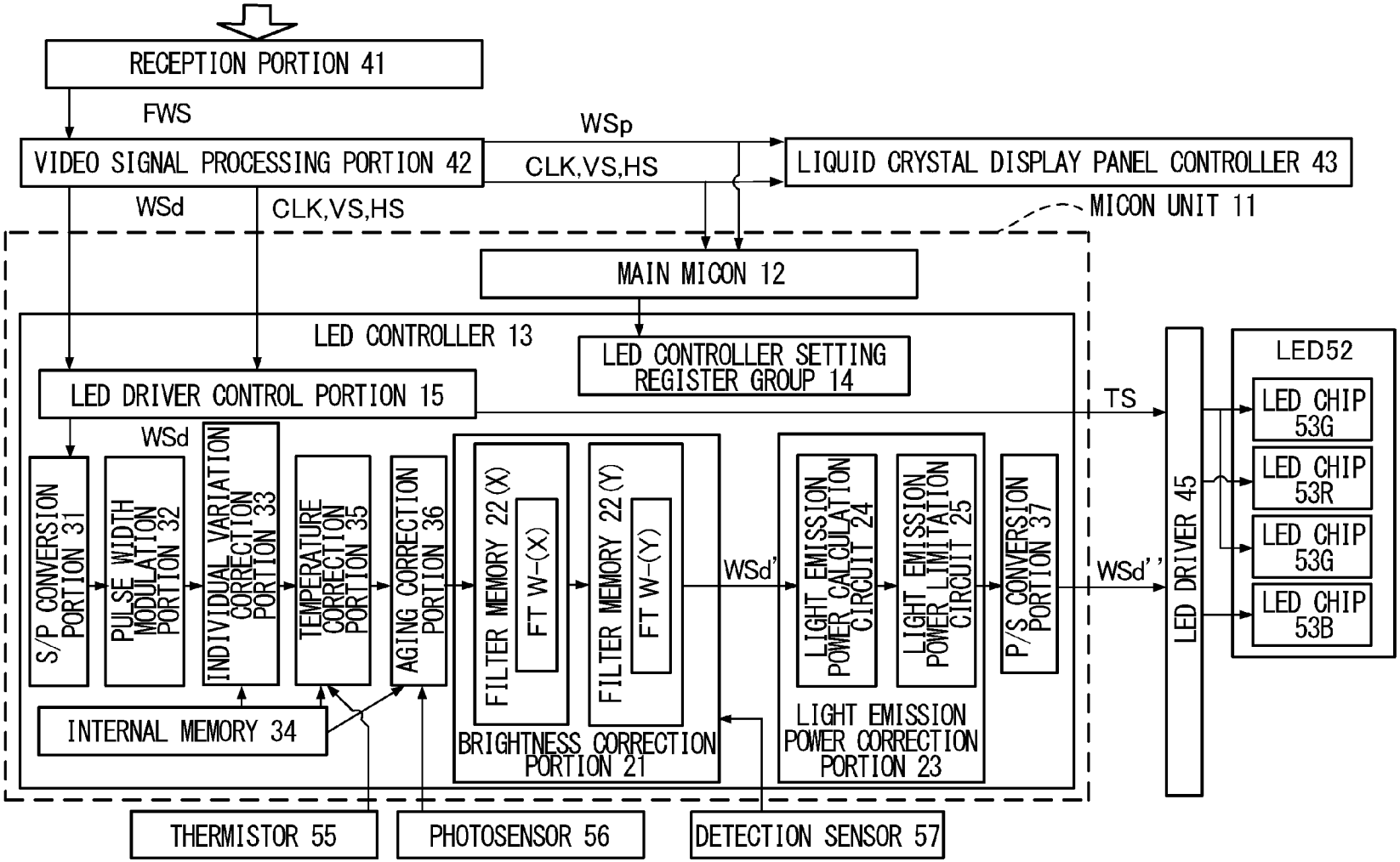
FIG. 22 A block diagram showing various members included in the liquid crystal display device.

By contrast, when the LEDs 52 emit white light by a method other than the mixture of colors, as shown in FIG. 22, the brightness correction portion 21 preferably performs the brightness correction processing using a filter FT-W (X, Y) (FT W-(X) and FT W-(Y)) corresponding to white light alone. In other words, when the LED 52 is a light source of a signal color (white) that emits light by a method other than the mixture of colors, the micon unit 11 preferably performs the brightness correction processing corresponding to the signal color.

In this way, control burden on the micon unit 11 is relatively reduced. However, the filter FT-W (X, Y) may differ for each of the parameters (such as the display mode, the APL value and the temperature of the LEDs 52).

Various signals (FWS, WSp, WSd, WSd' and WSd") shown in FIG. 22 are as follows.

FRS: a color video signal included in the basic video signals; a basic white video signal indicating white WSp: a process color video signal WS obtained by processing the basic white video signal; a process color video signal (panel process color video signal) transmitted to the liquid crystal display panel controller 43

WSd: a process color video signal WS obtained by processing the basic white video signal; a process color video signal (light source white video signal) transmitted to the LED controller 13

WSd': a light source white video signal after being subjected to the brightness correction processing WSd": a light source white video signal that is subjected to the light emission power correction processing after being subjected to the brightness correction processing The setting of the parameter by the backlight unit 69 (hence, the liquid crystal display device 89) may be automatically set by the micon unit 11 or may be manually set by the user.

Figure 23:
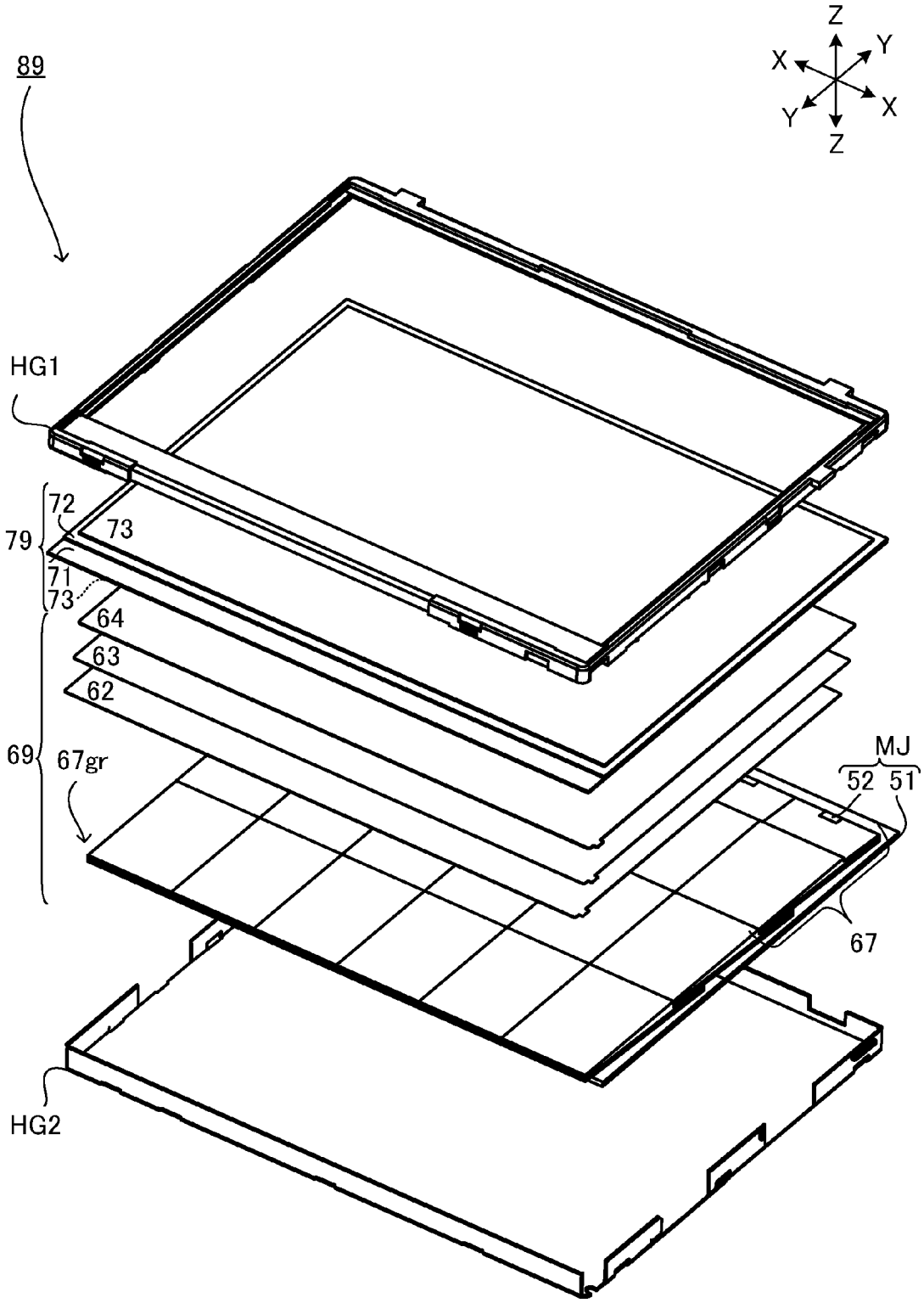
FIG. 23 An exploded perspective view of the liquid crystal display device.

In the above description, the so-called direct-type backlight unit 69 has been illustrated. However, the present invention is not limited to this configuration. For example, as shown in FIG. 23, a backlight unit (tandem-type backlight unit) 69 incorporating a tandem-type light guide plate 67*gr* over which wedge-shaped light guide parts 67 are placed may be used.

This is because, even in the backlight unit 69 described above, since the emitted light can be controlled on an individual light guide part 67 basis, it is possible to partially apply the light to the display region of the liquid crystal display panel 79. In other words, that is because the backlight unit 69 described above is also an active area type backlight unit 69.

In the above description, the reception portion 41 receives the video sound signal such as the television broadcast signal, and the video signal processing portion 42 processes the video signal in such a signal. Hence, a reception device incorporating the liquid crystal display device 89 described above can be said to be a television broadcast reception device (so-called liquid crystal television set). However, the video signal processed by the liquid crystal display device 89 is not limited to television broadcast. For example, the video signal may be a video signal that is included in a recoding medium where the content of a movie or the like is recorded or a video signal that is transmitted through the Internet.

Various types of correction processing including the brightness correction processing by the micon unit 11 are realized by a data generation program. The data generation program is a computer executable program, and may be recorded in a computer readable recording medium. This is because a program recorded in a recording medium is freely carried.

Examples of the recording medium described above include tapes such as a magnetic tape and a cassette tape that can be separated, discs of optical discs such as a magnetic disc and a CD-ROM, cards such as an IC card (including a memory card) and an optical card and semiconductor memories such as a flash memory.

The micon unit 11 may acquire the data generation program by communication through a communication network. Examples of the communication network include, regardless of wired or wireless network, the Internet and an infrared communication network.

Although, in the above description, in the backlight unit 69 taken as an example of the illumination device, the LEDs 52 are used as the light source, the present invention is not limited to this configuration. For example, the light source is not limited to the LEDs 52, and may be, for example, an organic EL (electro-luminescence) element, an inorganic EL element or the like.

In the above description, as an example of the illumination device, the liquid crystal display device 89 is taken. As a device incorporating the liquid crystal display device 89 described above, for example, there is a liquid crystal television set. As another example, the liquid crystal display device 89 is often incorporated in digital signage that functions as an advertisement pillar on the street.

LIST OF REFERENCE SYMBOLS

11 micon unit (control unit)
12 main micon (part of the control unit)
13 LED controller (part of the control unit)
14 LED controller register group (part of the control unit)
15 LED driver control portion (part of the control unit)
21 brightness correction portion (part of the control unit)
22 filter memory (part of the brightness correction portion)
23 light emission power correction portion (part of the control unit)
24 light emission power calculation circuit (part of the light emission power correction portion)
25 light emission power limitation circuit (part of the light emission power correction portion)
FT filter
41 reception portion
42 video signal processing portion
43 liquid crystal display panel controller
45 LED driver
MJ LED module
52 LED (light source)
53 LED chip (light emitting chip)
55 thermistor (temperature measurement portion)
56 photosensor
57 detection sensor (person detection portion)
69 backlight unit (illumination device)
79 liquid crystal display panel (display panel)
89 liquid crystal display device (display device)
SA illumination region
SAgr entire illumination region
X one direction within the plane of planar light
Y one direction within the plane of planar light

The invention claimed is:

1. An illumination device comprising:

a plurality of light sources which are arranged in a plane and in a matrix arrangement and which emit light according to light amount adjustment data to form planar light;

a controller configured or programmed to perform correction processing on light source control data based on image data to generate the light amount adjustment data; and a plurality of temperature sensors which measure a temperature of the plurality of light sources, each of the plurality of temperature sensors being arranged in a same horizontal plane as the plurality of light sources and at a center of a region surrounded by four of the plurality of light sources, the plurality of temperature sensors being evenly distributed among the matrix arrangement of the plurality of light sources such that each of the plurality of light sources is adjacent to only one of the plurality of temperature sensors, wherein based on a measurement by the temperature measurement sensors, the controller is configured or programmed to correct variations in brightness of the plurality of light sources resulting from a temperature of the plurality of light sources on the light source control data, the controller is configured or programmed to perform, along both an X axis direction and a Y axis direction within a plane of the planar light, brightness correction processing to adjust brightness distribution of the planar light on the light source control data on which the variations in brightness of the plurality of light sources resulting from the temperature of the plurality of light sources have been corrected so as to generate intermediate light source control data, the controller further is configured or programmed to calculate a total light emission power of all the light sources based on the intermediate light source control data, and perform, when the total light emission power exceeds an allowable light emission power, light emission power correction processing to adjust the total light emission power within the allowable light emission power on the intermediate light source control data so as to generate the light amount adjustment data.

2. The illumination device of claim 1, wherein, in the brightness correction processing, in each of the directions, a brightness around both ends in the direction is set lower than a brightness around a center.

3. The illumination device of claim 1, wherein, in the brightness correction processing, brightness correction processing having a plurality of levels using different filters according to the measurement by the temperature sensors is set stepwise, and the controller is configured or programmed to perform the brightness correction processing in the set stepwise order.

4. The illumination device of claim 1, wherein the controller is configured or programmed to calculate, for the total light emission power, a rate of limitation that is a scaling factor of the allowable light emission power, and multiply the intermediate light source control data on each of the light sources by the rate of limitation to generate the light amount adjustment data.

5. The illumination device of claim 1, wherein the light emission power correction processing is a final type of processing among types of processing performed by the controller on the light source control data.

6. The illumination device of claim 1, wherein the controller is configured or programmed to determine, based on a maximum value of the image data, the light source control data on each of the light sources.

7. The illumination device of claim 4, wherein each of the light sources includes light emitting chips of a plurality of colors, and generates white light by mixture of light, and when, in the light emission power correction processing, the controller is configured or programmed to: calculate the total light emission power, calculate a light emission power for individual light emission colors, calculate the total light emission power from a total sum of the light emission power and multiply the light emission power for the individual light emission colors by the same rate of limitation to generate the light amount adjustment data.

8. The illumination device of claim 1, wherein each of the light sources includes light emitting chips of a plurality of colors, and generates white light by mixture of light, and the controller is configured or programmed to perform a different type of the brightness correction processing for each of the colors.

9. The illumination device of claim 1, wherein the light sources are light sources of a single color, and the controller is configured or programmed to perform the brightness correction processing corresponding to the signal color.

10. A display device comprising:

the backlight unit of claim 1; and a liquid crystal display panel which displays an image according to the image data.

11. A data generation method of generating, in an illumination device, light amount adjustment data for controlling light emission of a plurality of light sources that are arranged in a plane and in a matrix arrangement to form planar light, wherein, when correction processing is performed on light source control data based on image data to generate the light amount adjustment data, variations in brightness of the plurality of light sources resulting from a temperature of the plurality of light sources are corrected on the light source control data, and along both an X axis direction and a Y axis direction within a plane of the planar light, brightness correction processing for adjusting brightness distribution of the planar light is performed on the light source control data on which the variations in brightness of the plurality of light sources resulting from the temperature of the plurality of light sources have been corrected so as to generate intermediate light source control data, the temperature being measured by a plurality of temperature sensors, each of the plurality of temperature sensors being arranged in a same horizontal plane as the plurality of light sources and at a center of a region surrounded by four of the plurality of light sources, the plurality of temperature sensors being evenly distributed among the matrix arrangement of the plurality of light sources such that each of the plurality of light sources is adjacent to only one of the plurality of temperature sensors, and based on the intermediate light source control data, a total light emission power of all the light sources is further calculated, and, when the total light emission power exceeds an allowable light emission power, light emission power correction processing for adjusting the total light emission power within the allowable light emission power is performed on the intermediate light source control data so as to generate the light amount adjustment data.

12. A non-transitory computer-readable recording medium including a data generation program for generating light amount adjustment data for use in an illumination device, wherein the illumination device includes a plurality of light sources which are arranged in a plane and in a matrix arrangement and which emit light according to the light amount adjustment data to form planar light and a controller configured or programmed to perform correction processing on light source control data based on image data to generate the light amount adjustment data, and the data generation program instructs the controller to perform a method comprising:

correcting variations in brightness of the plurality of light sources resulting from a temperature of the plurality of light sources on light source control data, the temperature being measured by a plurality of temperature sensors, each of the plurality of temperature measurement sensors being arranged in a same horizontal plane as the plurality of light sources and at a center of a region surrounded by four of the plurality of light sources, the plurality of temperature sensors being evenly distributed among the matrix arrangement of the plurality of light sources such that each of the plurality of light sources is adjacent to only one of the plurality of temperature sensors, performing, along both an X axis direction and a Y axis direction within a plane of the planar light, brightness correction processing for adjusting brightness distribution of the planar light on the light source control data on which the variations in brightness of the plurality of light sources resulting from the temperature of the plurality of light sources have been corrected so as to generate intermediate light source control data, and calculating a total light emission power of all the light sources based on the intermediate light source control data, and performing, when the total light emission power exceeds an allowable light emission power, light emission power correction processing for adjusting the total light emission power within the allowable light emission power on the intermediate light source control data so as to generate the light amount adjustment data.

* * * * *